US010508255B2

(12) United States Patent
Hori et al.

(10) Patent No.: US 10,508,255 B2
(45) Date of Patent: Dec. 17, 2019

(54) CLEANING COMPOSITION AND CLEANING METHOD

(71) Applicant: KAKEN TECH Co., Ltd., Osaka (JP)

(72) Inventors: Shigeo Hori, Osaka (JP); Hiroki Nakatsukasa, Osaka (JP); Yuki Akamatsu, Osaka (JP)

(73) Assignee: KAKEN TECH CO., LTD., Tokyo (JP)

( * ) Notice: Subject to any disclaimer, the term of this patent is extended or adjusted under 35 U.S.C. 154(b) by 109 days.

(21) Appl. No.: 15/568,861

(22) PCT Filed: Dec. 2, 2016

(86) PCT No.: PCT/JP2016/085861
§ 371 (c)(1),
(2) Date: Oct. 24, 2017

(87) PCT Pub. No.: WO2018/037579
PCT Pub. Date: Mar. 1, 2018

(65) Prior Publication Data

US 2019/0048294 A1 Feb. 14, 2019

(30) Foreign Application Priority Data

Aug. 25, 2016 (JP) ..... 2016-164944

(51) Int. Cl.
*C11D 3/20* (2006.01)
*C11D 3/26* (2006.01)
(Continued)

(52) U.S. Cl.
CPC ..... *C11D 7/5009* (2013.01); *C11D 3/0073* (2013.01); *C11D 7/5013* (2013.01);
(Continued)

(58) Field of Classification Search
CPC ..... C11D 3/20; C11D 3/2006; C11D 3/26; C11D 3/30; C11D 3/34; C11D 7/50
See application file for complete search history.

(56) References Cited

U.S. PATENT DOCUMENTS 5,498,805 A * 3/1996 Koetzle ..... C11D 3/18 510/407
2013/0096044 A1* 4/2013 Hori ..... B23K 35/3612 510/175

FOREIGN PATENT DOCUMENTS

JP H03-62896 A 3/1991
WO 2012/005068 A1 9/2013

* cited by examiner

*Primary Examiner* — Brian P Mruk
(74) *Attorney, Agent, or Firm* — Fitch, Even, Tabin & Flannery L.L.P.

(57) ABSTRACT

Provided are a cleaner composition that can exhibit excellent cleaning ability by including a predetermined amount of water, and can also effectively suppress metal corrosion; and a cleaning method thereof. Disclosed is a cleaner composition in a white turbid state including first to fourth organic solvents and water, in which the first organic solvent is a hydrophobic aromatic compound or the like; the second organic solvent is a hydrophobic monoalcohol compound; the third organic solvent is a predetermined hydrophilic nitrogen-containing compound or the like; the fourth organic solvent is a hydrophilic amine compound; the amount of incorporation of water is adjusted to a value within the range of 50 to 3,900 pbw with respect to 100 pbw of the total amount of the organic solvents, and when the cleaner composition is subjected to phase separation, the water concentration in the oil phase is adjusted to a value of 5 wt. % or less.

10 Claims, 5 Drawing Sheets

(51) Int. Cl.

| | |
|---|---|
| ***C11D 3/30*** | (2006.01) |
| ***C11D 3/34*** | (2006.01) |
| ***C11D 7/50*** | (2006.01) |
| ***C23G 5/036*** | (2006.01) |
| ***C23G 5/024*** | (2006.01) |
| ***C11D 17/00*** | (2006.01) |
| ***C11D 3/00*** | (2006.01) |
| ***C23G 5/032*** | (2006.01) |
| ***C23G 5/06*** | (2006.01) |
| ***C11D 11/00*** | (2006.01) |

(52) U.S. Cl.

CPC ..... *C11D 7/5022* (2013.01); *C11D 7/5027* (2013.01); *C11D 7/5031* (2013.01); *C11D 11/0029* (2013.01); *C11D 17/0017* (2013.01); *C23G 5/024* (2013.01); *C23G 5/032* (2013.01); *C23G 5/036* (2013.01); *C23G 5/06* (2013.01)

CLEANING COMPOSITION AND CLEANING METHOD

CROSS-REFERENCE TO RELATED APPLICATIONS

This application is a U.S. national phase application filed under 35 U.S.C. § 371 of International Application PCT/JP2016/085861, filed on Dec. 2, 2016, designating the United States, which claims benefit of the filing date of JP 2016-164944, filed on Aug. 25, 2016, the entire contents of each of which are hereby incorporated herein by reference.

TECHNICAL FIELD

The present invention relates to a cleaner composition and a cleaning method.

More particularly, the invention relates to a cleaner composition that is excellent in environmental safety and can exhibit excellent cleaning ability by including a predetermined amount of water, and can also effectively suppress metal corrosion in an object of washing, and to a cleaning method.

BACKGROUND ART

It is conventionally known that when a semiconductor device, a condenser or the like is soldered to a lead frame or the like, flux is scattered from the solder paste and adheres as residue around electrodes (hereinafter, such a residue of flux will be referred to as "flux residue").

Such a flux residue is causative of corrosion in solder joint areas or the like and is also causative of defective joining in a wire bonding process or defective adhesion to the mold resin in a resin sealing process, and therefore, such a flux residue needs to be removed with a cleaner. Thus, a variety of cleaners have been suggested hitherto (see, for example, Patent Documents 1 and 2).

That is, Patent Document 1 discloses a cleaner composition including a cyclic saturated hydrocarbon having 9 to 18 carbon atoms at a proportion of 70% by weight or more.

Furthermore, Patent Document 2 discloses a cleaner composition for cleaning an object of cleaning in a white turbid state, the cleaner composition including 50 to 1900 parts by weight of water with respect to 100 parts by weight of a cleaner composition stock solution, in which the cleaner composition stock solution includes a first organic solvent and a second organic solvent as organic solvents; the first organic solvent is at least one compound selected from the group consisting of a hydrophobic glycol ether compound, a hydrophobic hydrocarbon compound, a hydrophobic aromatic compound, a hydrophobic ketone compound, and a hydrophobic alcohol compound, all of which has a boiling point value within the range of 140° C. to 190° C. and a solubility value in water (measurement temperature: 20° C.) of 50% by weight or less; the second organic solvent is a hydrophilic amine compound having a boiling point value within the range of 140° C. to 190° C. and a solubility value in water (measurement temperature: 20° C.) of above 50% by weight; the amount of incorporation of the second organic solvent is adjusted to a value within the range of 0.3 to 30 parts by weight with respect to 100 parts by weight of the first organic solvent; and the amount of incorporation of an organic solvent having a boiling point value of above 190° C. is adjusted to 0 parts by weight or a value within the range of 0 to 15 parts by weight (provided that 0 parts by weight is not included) with respect to 100 parts by weight of the first organic solvent.

CITATION LIST

Patent Document

Patent Document 1: JP 3-62896 A (claims)
Patent Document 2: WO 2012/005068 (claims)

SUMMARY OF THE INVENTION

Problem to be Solved by the Invention

However, the cleaner composition described in Patent Document 1 is composed of organic solvents only, or organic solvents and surfactants only, and no water is incorporated at all. Therefore, there is a problem that the cleaner composition is not satisfactory in view of environmental safety.

Furthermore, there is no intention in suggesting that the cleaning ability can be effectively enhanced by bringing the cleaner composition into a white turbid state (emulsion state) by incorporating water into the composition.

Meanwhile, since it is essential for the cleaner composition described in Patent Document 2 that a relatively large amount of water is incorporated into the cleaner composition, and the composition should be used in a white turbid state, a balance can be achieved between excellent environmental safety and cleaning ability.

However, since the cleaner composition described in Patent Document 2 includes a hydrophilic amine compound as an essential component, there is a problem that the electrical conductivity and pH of the aqueous phase increase, and metal corrosion is likely to occur in the object of cleaning.

Particularly, in the case of cleaning a lead frame that is obtained by soldering a semiconductor device having a bonding pad of aluminum (hereinafter, may be referred to as "aluminum pad") formed thereon as an object of cleaning, the problem was recognized.

That is, in the lead frame described above, in addition to the aluminum that constitutes the aluminum pad formed on the semiconductor device, dissimilar metals such as gold and silver that similarly constitute a pad; a copper alloy that constitutes the main body of a lead frame; nickel that is applied by plating to the main body of a lead frame; tin, lead, and silver that are included in solder, are joined to the lead frame by means of circuits.

Accordingly, it is known that when such a lead frame is immersed in an electrically conductive cleaner composition, closed circuits are formed, and metals having lower potential are corroded sacrificially (hereinafter, such corrosion will be referred to as "potential difference corrosion"). According to the "electrochemical electric potential table (electrochemical potential table)", there is a potential difference of 0.75 V between nickel and aluminum, and there is a potential difference of 1.05 V between gold and aluminum. These potential differences are 0.35 V or higher, at which it is considered that there is a risk of the occurrence of potential difference corrosion in information processing devices and the like, and aluminum always becomes an object of corrosion at the anode potential.

Furthermore, in regard to the corrosion of metals, it is known that the above-mentioned electric potential and pH are involved, in addition to the dependency on the type of electrolyte (hereinafter, such corrosion will be referred to as "pH corrosion").

In regard to such corrosion of metals, various "pH-potential diagrams" have been reported, and metal regions, corrosion regions, and the like are shown therein.

According to the pH-potential diagram for aluminum, it is considered that aluminum metal is generally converted to aluminate ion ($AlO_2$—) in an alkaline aqueous solution at pH 9 or higher and at the anode potential condition, and thereby undergoes dissolution corrosion.

As such, when the above-mentioned lead frame is cleaned with a cleaner composition at pH 9 or higher containing alkali components such as an amine compound, usually, the film thickness of an aluminum pad, which is about 1 μm, may be reduced, or in extreme cases, the aluminum pad may be dissolved and lost. Thus, wire bonding bondability is affected.

Meanwhile, in a case in which simply the hydrophilic amine compound is removed from the cleaner composition described in Patent Document 2, cleaning ability is deteriorated as dispersibility of the emulsion is decreased, and the cleaning ability provided by the hydrophilic amine compound is entirely deducted. Therefore, there is a problem that it is markedly difficult to maintain desired cleaning ability.

Thus, the inventors of the present invention conducted a thorough investigation, and as a result, the inventors found that the problems described above can be solved by mixing predetermined hydrophobic organic solvents as first and second organic solvents, a predetermined hydrophilic organic solvent as a third organic solvent, and water at predetermined proportions; by not incorporating a hydrophilic amine compound as a fourth organic solvent, or if the cleaner composition includes the hydrophilic amine compound, by adjusting the amount of the hydrophilic amine compound to a value below a predetermined value; and by adjusting the water concentration in an oil phase that is obtainable when the cleaner composition is subjected to phase separation, to a predetermined range or less. Thus, the inventors completed the present invention.

That is, an object of the present invention is to provide a cleaner composition that is excellent in environmental safety and can exhibit excellent cleaning ability, and can also effectively suppress metal corrosion in an object of cleaning, and a cleaning method using the cleaner composition.

Means for Solving Problem

According to an aspect of the present invention, there is provided a cleaner composition for cleaning an object of cleaning in a white turbid state, the cleaner composition comprising first to fourth organic solvents and water, in which the first organic solvent is at least one compound selected from the group consisting of a hydrophobic aromatic compound, a hydrophobic terpene-based compound, and a hydrophobic naphthene-based compound, all of these compounds having a solubility value in water (measurement temperature: 20° C.) of 10% by weight (wt. %) or less, the second organic solvent is a hydrophobic monoalcohol compound having a solubility value in water (measurement temperature: 20° C.) of 10% by weight or less, the third organic solvent is a hydrophilic nitrogen-containing compound and a hydrophilic sulfur-containing compound, or any one of the compounds, both having a solubility value in water (measurement temperature: 20° C.) of 50% by weight or greater, the fourth organic solvent is a hydrophilic amine compound having a solubility value in water (measurement temperature: 20° C.) of 50% by weight or greater, the amount of incorporation of the second organic solvent is adjusted to a value within the range of 3 to 100 parts by weight (pbw) with respect to 100 parts by weight of the first organic solvent, the amount of incorporation of the third organic solvent is adjusted to a value within the range of 3 to 100 parts by weight with respect to 100 parts by weight of the first organic solvent, the amount of incorporation of the fourth organic solvent is adjusted to a value of below 0.1 parts by weight with respect to 100 parts by weight of the first organic solvent, the amount of incorporation of water is adjusted to a value within the range of 50 to 3,900 parts by weight with respect to 100 parts by weight of the total amount of the organic solvents, and when the cleaner composition is subjected to phase separation into an oil phase and an aqueous phase, the water concentration in the oil phase (measurement temperature: 25° C.) is adjusted to a value of 5% by weight or less. Thus, the problems mentioned above can be solved.

That is, regarding the cleaner composition of the present invention, since predetermined hydrophobic organic solvents, a predetermined hydrophilic organic solvent, and water are mixed at predetermined proportions, the cleaner composition can be stably subjected to phase separation into an oil phase and an aqueous phase, and thereby an object of cleaning can be cleaned in a white turbid state.

Therefore, the cleaning ability attributed to the organic solvents themselves in the cleaner composition and the turbid state of the cleaner composition exhibit a synergistic effect, and excellent washing performance may be obtained.

Furthermore, excellent environmental safety can be obtained by incorporating a relatively large amount of water into the composition.

Furthermore, since a hydrophilic amine compound is not included, or if included, since the hydrophilic amine compound is included in an amount within the range of below a predetermined amount, even in a case in which an object of cleaning including a portion formed from aluminum or the like is cleaned, the occurrence of metal corrosion can be effectively suppressed.

Meanwhile, when the amount of incorporation of the hydrophilic amine compound is limited, cleaning ability tends to deteriorate noticeably; however, since the cleaner composition is made to have a predetermined mixing composition, and the water concentration in the oil phase is adjusted to a predetermined range or less, excellent cleaning ability can be effectively maintained.

The term "solubility in water" according to the present invention means the percentage by weight of the solvent that can be dissolved in 100% by weight of water. Therefore, the solubility has the same value as the weight (g) of the solvent that can be dissolved in 100 g of water.

Furthermore, in a case in which there exists an organic solvent that belongs to both the first organic solvent and the second organic solvent, the organic solvent will be classified as the first organic solvent, and in a case in which there exists an organic solvent that belongs to both the third organic solvent and the fourth organic solvent, the organic solvent will be classified as the fourth organic solvent.

On the occasion of configuring the cleaner composition of the present invention, it is preferable that the electrical conductivity of the aqueous phase (measurement temperature: 25° C.) is adjusted to a value within the range of 0.1 to 300 μS/cm.

By configuring the cleaner composition as such, the occurrence of potential difference corrosion can be suppressed more effectively.

Furthermore, on the occasion of configuring the cleaner composition of the present invention, it is preferable that the pH of the aqueous phase (measurement temperature: 25° C.) is adjusted to a value within the range of 4.5 to 9.5.

By configuring the cleaner composition as such, the occurrence of pH corrosion can be suppressed more effectively.

Furthermore, on the occasion of configuring the cleaner composition of the present invention, it is preferable that the boiling point of the first organic solvent is adjusted to a value within the range of 140° C. to 210° C., the boiling point of the second organic solvent is adjusted to a value within the range of 130° C. to 220° C., and the boiling point of the third organic solvent is adjusted to a value within the range of 150° C. to 220° C.

By configuring the cleaner composition as such, the dryability and the regeneration efficiency of the cleaner composition after use can be effectively enhanced.

Furthermore, on the occasion of configuring the cleaner composition of the present invention, it is preferable that the number of carbon atoms in the hydrophobic aromatic compound, hydrophobic terpene-based compound, and hydrophobic naphthene-based compound as the first organic solvents is adjusted to a value within the range of 8 to 10, the number of hydrogen atoms is adjusted to a value within the range of 8 to 20, and the number of oxygen atoms is adjusted to a value within the range of 0 to 1.

By configuring the cleaner composition as such, cleaning ability can be more effectively enhanced by bringing the first organic solvent into an emulsion state more stably.

On the occasion of configuring the cleaner composition of the present invention, it is preferable that the number of carbon atoms in the hydrophobic monoalcohol compound as the second organic solvent is adjusted to a value within the range of 6 to 10, the number of hydrogen atoms is adjusted to a value within the range of 8 to 20, and the number of oxygen atoms is adjusted to 1.

By configuring the cleaner composition as such, dispersibility in water of the first organic solvent that has been brought to an emulsion state can be further enhanced, and the cleaning ability can be further enhanced.

On the occasion of configuring the cleaner composition of the present invention, it is preferable that the number of carbon atoms in the hydrophilic nitrogen-containing compound as the third organic solvent is adjusted to a value within the range of 3 to 6, the number of hydrogen atoms is adjusted to a value within the range of 7 to 12, the number of nitrogen atom is adjusted to 1, and the number of oxygen atoms is adjusted to 1; and the number of carbon atoms in the hydrophilic sulfur-containing compound is adjusted to a value within the range of 2 to 3, the number of hydrogen atoms is adjusted to a value within the range of 6 to 10, the number of sulfur atoms is adjusted to 1, and the number of oxygen atoms is adjusted to 1.

By configuring the cleaner composition as such, any ionic compounds of organic acids and salts originating from flux residue, and ion components originating from the object of cleaning can be effectively dissolved in an aqueous phase, and the cleaning ability can be further enhanced.

On the occasion of configuring the cleaner composition of the present invention, it is preferable that the number of carbon atoms in the hydrophilic amine compound as the fourth organic solvent is adjusted to a value within the range of 3 to 7, the number of hydrogen atoms is adjusted to a value within the range of 8 to 16, the number of nitrogen atoms is adjusted to a value within the range of 1 to 3, and the number of oxygen atoms is adjusted to 1.

By configuring the cleaner composition as such, particularly in a case in which a high degree of cleaning ability is required, the cleaning ability can be further enhanced even with a small amount is added.

On the occasion of configuring the cleaner composition of the present invention, it is preferable that the object of cleaning contains, in an exposed surface, at least one metal selected from the group consisting of magnesium, aluminum, phosphorus, titanium, chromium, iron, nickel, copper, zinc, germanium, palladium, silver, indium, tin, antimony, platinum, gold, lead, and bismuth, or an alloy containing that metal.

Even in a case in which such an object of cleaning is subjected to the action of the cleaner composition, the occurrence of metal corrosion can be effectively suppressed.

According to another aspect of the present invention, there is provided a cleaning method of cleaning an object of cleaning by bringing the above-described cleaner composition into a white turbid state.

Namely, the presented cleaning method comprises a step for preparing the cleaner composition according to claim 1, and a step for cleaning an object by bringing the cleaner composition which is a white turbid state.

That is, according to the cleaning method of the present invention, since a predetermined cleaner composition is used, the cleaning method is excellent in environmental safety, can exhibit excellent cleaning ability, and can effectively suppress metal corrosion in an object of cleaning.

MODE(S) FOR CARRYING OUT THE INVENTION

First Embodiment

Figure 1:
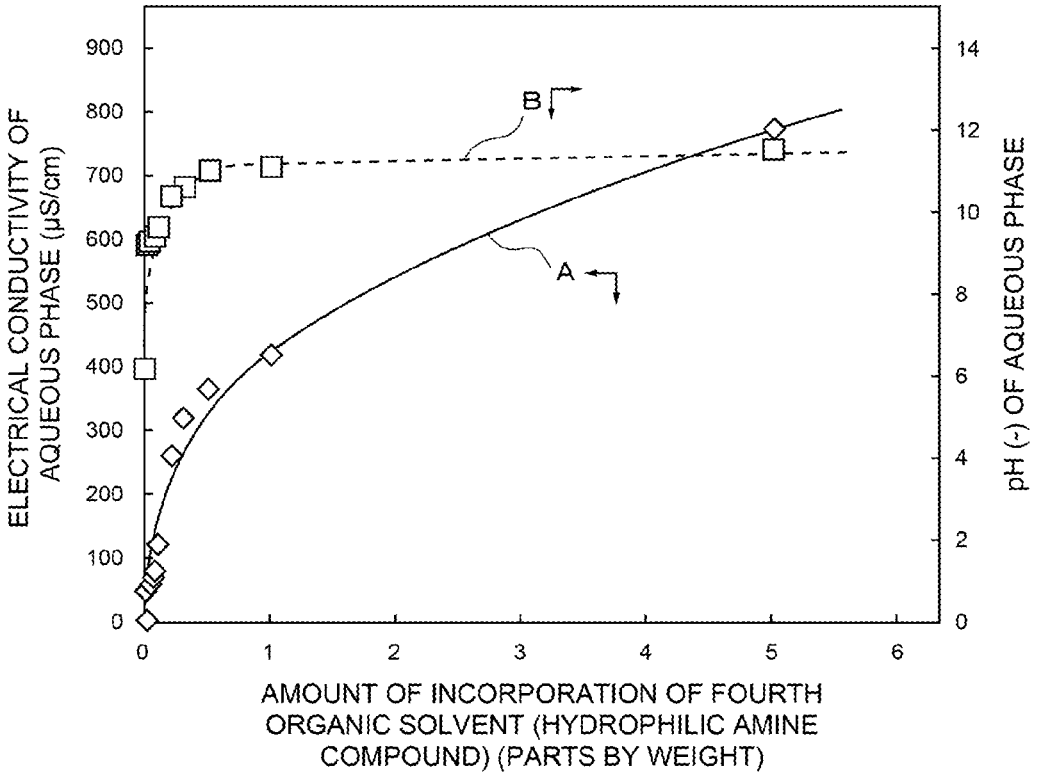
FIG. 1 is a diagram provided to explain the relations between the amount of incorporation of the fourth organic solvent and the electrical conductivity and pH of the aqueous phase.

A first embodiment is a cleaner composition for cleaning an object of cleaning in a white turbid state, the cleaner composition including first to fourth organic solvents and water, in which:

the first organic solvent is at least one compound selected from the group consisting of a hydrophobic aromatic compound, a hydrophobic terpene-based compound, and a hydrophobic naphthene-based compound, all of these compounds having a solubility value in water (measurement temperature: 20° C.) of 10% by weight or less, the second organic solvent is a hydrophobic monoalcohol compound having a solubility value in water (measurement temperature: 20° C.) of 10% by weight or less, the third organic solvent is a hydrophilic nitrogen-containing compound and a hydrophilic sulfur-containing compound, or any one of the compounds, both compounds having a solubility value in water (measurement temperature: 20° C.) of 50% by weight or greater, the fourth organic solvent is a hydrophilic amine compound having a solubility value in water (measurement temperature: 20° C.) of 50% by weight or greater, the amount of incorporation of the second organic solvent is adjusted to a value within the range of 3 to 100 parts by weight with respect to 100 parts by weight of the first organic solvent, the amount of incorporation of the third organic solvent is adjusted to a value within the range of 3 to 100 parts by weight with respect to 100 parts by weight of the first organic solvent, the amount of incorporation of the fourth organic solvent is adjusted to a value of below 0.1 parts by weight with respect to 100 parts by weight of the first organic solvent, the amount of incorporation of water is adjusted to a value within the range of 50 to 3,900 parts by weight with respect to 100 parts by weight of the total amount of organic solvents, and when the cleaner composition is subjected to phase separation into an oil phase and an aqueous phase, the water concentration in the oil phase (measurement temperature 25° C.) is adjusted to a value of 5% by weight or less.

1. First Organic Solvent

The first organic solvent that constitutes the cleaner composition of the invention is at least one compound selected from the group consisting of a hydrophobic aromatic compound, a hydrophobic terpene-based compound, and a hydrophobic naphthene-based compound, all of these compounds having a solubility value in water (measurement temperature: 20° C.) of 10% by weight or less.

Such a first organic solvent is converted to an emulsion state and contributes to bringing the cleaner composition into a white turbid state, together with the effects of the second and third organic solvents that will be described below.

Furthermore, since the first organic solvent has excellent dissolution power for flux residues, the cleaning ability can be effectively enhanced.

Therefore, due to a synergistic effect of the excellent cleaning ability intrinsic to the first organic solvent and the conversion of the first organic solvent into an emulsion state, the first organic solvent plays a role of imparting excellent cleaning ability to the cleaner composition.

(1) Type

The first organic solvent is at least one compound selected from the group consisting of a hydrophobic aromatic compound, a hydrophobic terpene-based compound, and a hydrophobic naphthene-based compound.

More specifically, examples thereof include indene (boiling point: 182° C., solubility in water: 1% by weight or less), hemimellitene (boiling point: 176° C., solubility in water: 1% by weight or less), pseudocumene (boiling point: 169° C., solubility in water: 1% by weight or less), mesitylene (boiling point: 165° C., solubility in water: 1% by weight or less), cumene (boiling point: 152° C., solubility in water: 1% by weight or less), cymene (boiling point: 177° C., solubility in water: 1% by weight or less), phenetole (boiling point: 173° C., solubility in water: 1% by weight or less), limonene (176° C., solubility in water: 1% by weight or less), α-pinene (for example, included in turpentine oil as a main component) (boiling point: 155° C. to 156° C., solubility in water: 1% by weight or less), p-menthane (boiling point: 168° C., solubility in water: 1% by weight or less), decahydronaphthalene (boiling point: 186° C., solubility in water: 1% by weight or less), octahydroindene (boiling point: 159° C., solubility in water: 1% by weight or less), pinane (boiling point: 167° C., solubility in water: 1% by weight or less), p-menthadiene isomer mixture (for example, manufactured by Nippon Terpene Chemicals, Inc., DIPENTENE T) (boiling point: 168° C. to 182° C., solubility in water: 1% by weight or less), and a C9 alkyl cyclohexane mixture (for example, manufactured by Maruzen Petrochemical Co., Ltd., SWACLEAN 150) (boiling point: 145° C. to 170° C., solubility in water: 1% by weight or less).

It is preferable that the number of carbon atoms in the hydrophobic aromatic compound, hydrophobic terpene-based compound, and hydrophobic naphthene-based compound as the first organic solvent is adjusted to a value within the range of 8 to 10, the number of hydrogen atoms is adjusted to a value within the range of 8 to 20, and the number of oxygen atoms is adjusted to a value within the range of 0 to 1.

The reason for this is that when such a compound is used, the first organic solvent can be more stably converted to an emulsion state, and the cleaning ability can be more effectively enhanced.

Therefore, among the first organic solvents described above, particularly, at least one compound selected from the group consisting of indene, cymene, cumene, phenetole, decahydronaphthalene, and p-menthane is preferable.

(2) Solubility

Furthermore, the solubility in water (measurement temperature: 20° C.) of the first organic solvent is adjusted to a value of 10% by weight or less.

The reason for this is that if such solubility has a value of above 10% by weight, it is difficult to regulate the water concentration in the oil phase to a predetermined range or lower, and thereby, it may be difficult for the first organic solvent to sufficiently exhibit the excellent cleaning ability that is originally possessed by the organic solvent, in a water-free state.

Therefore, it is more preferable to adjust the upper limit of the solubility in water (measurement temperature: 20° C.) of the first organic solvent to a value of 5% by weight or less, and even more preferably to a value of 3% by weight or less.

(3) Boiling Point

Furthermore, it is preferable that the boiling point of the first organic solvent is adjusted to a value within the range of 140° C. to 210° C.

The reason for this is that if such a boiling point has a value of below 140° C., the amount of volatilization during use becomes large, and the amount of liquid consumption also becomes large, so that the economic efficiency becomes poor.

On the other hand, it is because if such a boiling point has a value of above 210° C., the first organic solvent has poor dryability, defective drying occurs, and thus the first organic solvent is likely to remain on the object of cleaning. Also, it is because when it is attempted to enhance dryability, excessive thermal energy must be applied to the object of cleaning during drying. Furthermore, it is because when the cleaner composition after use is regenerated by fractional distillation, the energy required may become excessively large, high-boiling point components may not be distilled out during regeneration, the recovery ratio of the cleaner composition may be decreased, or a cleaner composition having a predetermined composition may not be obtained, so that the regeneration efficiency is likely to decrease. Furthermore, it is because since the heating temperature employed at the time of subjecting the cleaner composition after use to fractional distillation becomes higher, the constituent components of the cleaner composition are likely to undergo decomposition or the like, the cleaning ability of the cleaner composition after regeneration is deteriorated, and it may be difficult to stably obtain a cleaner composition having sufficient cleaning ability.

Therefore, it is more preferable that the lower limit of the boiling point for the first organic solvent is adjusted to a value of 145° C. or higher, and even more preferably to a value of 150° C. or higher.

It is also more preferable that the upper limit of the boiling point for the first organic solvent is adjusted to a value of 200° C. or lower, and even more preferably to a value of 190° C. or lower.

(4) Amount of Incorporation

Furthermore, it is preferable that the amount of incorporation of the first organic solvent is adjusted to a value within the range of 40% to 90% by weight with respect to the total amount (100% by weight) of the organic solvent portion of the cleaner composition (hereinafter, may be referred to as "cleaner composition stock solution").

The reason for this is that if such an amount of incorporation has a value of below 40% by weight, phase separation does not easily occur, it may be difficult to obtain a white turbid state, and the cleaning ability is likely to deteriorate excessively.

On the other hand, it is because if such an amount of incorporation has a value of above 90% by weight, the separation between an oil phase and an aqueous phase may occur excessively vigorously, it may be difficult to stably obtain a white turbid state, and the cleaning ability is likely to deteriorate.

Therefore, it is more preferable to adjust the lower limit of the amount of incorporation of the first organic solvent to a value of 45% by weight or more, and even more preferably to a value of 50% by weight or more, with respect to the total amount (100% by weight) of the cleaner composition stock solution.

Furthermore, it is more preferable to adjust the upper limit of the amount of incorporation of the first organic solvent to a value of 80% by weight or less, and even more preferably to a value of 75% by weight or less, with respect to the total amount (100% by weight) of the cleaner composition stock solution.

2. Second Organic Solvent

The second organic solvent of the present invention is a hydrophobic monoalcohol compound having a solubility value in water (measurement temperature: 20° C.) of 10% by weight or less.

Such a second organic solvent acts as an intermediary from the oil phase between water and the first organic solvent that has been converted to an emulsion state, and contributes to enhancing the dispersed state of the emulsion. Also, the second organic solvent has excellent dissolvability particularly for rosins.

Therefore, the second organic solvent plays a role of assisting, from the oil phase, the first organic solvent that has been converted to an emulsion state, and enhancing the cleaning ability of the cleaner composition.

(1) Type

The second organic solvent is a hydrophobic monoalcohol compound.

More specifically, examples thereof include 1-hexanol (boiling point: 157° C., solubility in water: 1% by weight or less), methyl amyl alcohol (boiling point: 131° C., solubility in water: 1.6% by weight), 2-ethyl butyl alcohol (boiling point: 147° C., solubility in water: 1% by weight), methyl isobutyl carbinol (boiling point: 131° C., solubility in water: 1.5% by weight), cyclohexanol (boiling point: 161° C., solubility in water: 3.6% by weight), 1-heptanol (boiling point: 175° C., solubility in water: 1% by weight or less), 2-heptanol (boiling point: 160° C., solubility in water: 1% by weight or less), 3-heptanol (boiling point: 156° C., solubility in water: 1% by weight or less), 4-heptanol (boiling point: 156° C., solubility in water: 1% by weight or less), 2-methylcyclohexanol (boiling point: 173° C., solubility in water: 1% by weight or less), benzyl alcohol (boiling point: 206° C., solubility in water: 4.3% by weight), 1-octanol (boiling point: 195° C., solubility in water: 1% by weight or less), 2-octanol (boiling point: 178° C., solubility in water: 1% by weight or less), 2-ethylhexanol (boiling point: 184° C., solubility in water: 1% by weight or less), 2-nonanol (boiling point: 193° C., solubility in water: 1% by weight or less), diisobutylcarbinol (boiling point: 176° C., solubility in water: 1% by weight or less), 3,5,5-trimethylhexanol (boiling point: 194° C., solubility in water: 1% by weight or less), and terpineol (boiling point: 217° C., solubility in water: 1% by weight or less).

Furthermore, it is preferable that the number of carbon atoms in the hydrophobic monoalcohol compound as the second organic solvent is adjusted to a value within the range of 6 to 10, the number of hydrogen atoms is adjusted to a value within the range of 8 to 20, and the number of oxygen atoms is adjusted to 1.

The reason for this is that when such a compound is used, the dispersibility in water of the first organic solvent that has been converted to an emulsion state can be further enhanced, and the cleaning ability can be further enhanced.

Therefore, among the second organic solvents described above, particularly, at least one compound selected from the group consisting of 1-hexanol, cyclohexanol, 1-heptanol, 2-heptanol, benzyl alcohol, 1-octanol, diisobutylcarbinol, and terpineol is preferable.

(2) Solubility

The solubility in water (measurement temperature: 20° C.) of the second organic solvent is adjusted to a value of 10% by weight or less.

The reason for this is that if such solubility has a value of above 10% by weight, it may be difficult for the second organic solvent to act as an intermediary from the oil phase between water and the first organic solvent that has been converted to an emulsion state, and to bring enhancement of the dispersibility of the emulsion and enhancement of the cleaning ability.

Furthermore, it is because it may be difficult to regulate the water concentration in the oil phase to a predetermined range or less, and it may be difficult for the first organic solvent and the second organic solvent to exhibit the excellent cleaning ability that is originally possessed by the organic solvents, in a water-free state.

Therefore, it is more preferable that the upper limit of the solubility in water (measurement temperature: 20° C.) of the second organic solvent is adjusted to a value of 7% by weight or less, and even more preferably to a value of 5% by weight or less.

(3) Boiling Point

It is also preferable that the boiling point of the second organic solvent is adjusted to a value within the range of 130° C. to 220° C.

The reason for defining the boiling point of the second organic solvent is similar to the reason for defining the boiling point of the first organic solvent.

Therefore, it is more preferable that the lower limit of the boiling point for the second organic solvent is adjusted to a value of 140° C. or higher, and even more preferably to a value of 150° C. or higher.

It is also more preferable that the upper limit of the boiling point for the second organic solvent is adjusted to a value of 215° C. or lower, and even more preferably to a value of 210° C. or lower.

(4) Amount of Incorporation

Furthermore, the amount of incorporation of the second organic solvent is adjusted to a value within the range of 3 to 100 parts by weight with respect to 100 parts by weight of the first organic solvent.

The reason for this is that if such an amount of incorporation has a value of below 3 parts by weight, the absolute amount of the second organic solvent with respect to the first organic solvent may be insufficient, and it may be difficult for the second organic solvent to act as an intermediary from the oil phase between water and the first organic solvent that has been converted to an emulsion state, and to bring enhancement of the dispersibility of the emulsion and enhancement of the cleaning ability.

It is also because it may be difficult to obtain the excellent cleaning ability that is originally possessed by the second organic solvent.

On the other hand, it is because if such an amount of incorporation has a value of above 100 parts by weight, phase separation may not easily occur, it may be difficult to obtain a white turbid state, and the cleaning ability is likely to deteriorate excessively.

Therefore, it is more preferable that the lower limit of the amount of incorporation of the second organic solvent is adjusted to a value of 7 parts by weight or more, and even more preferably to a value of 10 parts by weight or more, with respect to 100 parts by weight of the first organic solvent.

Furthermore, it is more preferable that the upper limit of the amount of incorporation of the second organic solvent is adjusted to a value of 90 parts by weight or less, and even more preferably to a value of 80 parts by weight or less, with respect to 100 parts by weight of the first organic solvent.

3. Third Organic Solvent

The third organic solvent of the invention is a hydrophilic nitrogen-containing compound and a hydrophilic sulfur-containing compound, or any one of the compounds, both compounds having a solubility value in water (measurement temperature: 20° C.) of 50% by weight or greater.

Such a third organic solvent can sufficiently dissolve ionic compounds such as organic acids and salts originating from flux residues, or ion components originating from an object of cleaning, in an aqueous phase, also acts as an intermediary from the aqueous phase between water and the first and second organic solvents, and contributes to enhancement of the dispersibility of the emulsion.

Therefore, the third organic solvent plays a role of assisting the first organic solvent that has been converted to an emulsion state and the like from the aqueous phase side, and enhancing the cleaning ability of the cleaner composition.

(1) Type

The third organic solvent is a hydrophilic nitrogen-containing compound and a hydrophilic sulfur-containing compound, or any one of the compounds.

Furthermore, it is preferable that the number of carbon atoms in the hydrophilic nitrogen-containing compound as the third organic solvent is adjusted to a value within the range of 3 to 6, the number of hydrogen atoms is adjusted to a value within the range of 7 to 12, the number of nitrogen atoms is adjusted to 1, and the number of oxygen atoms is adjusted to 1; and the number of carbon atoms in the hydrophilic sulfur-containing compound is adjusted to a value within the range of 2 to 3, the number of hydrogen atoms is adjusted to a value within the range of 6 to 10, the number of sulfur atoms is adjusted to 1, and the number of oxygen atoms is adjusted to 1.

The reason for this is that when such a compound is used, ionic compounds such as organic acids and salts originating from flux residues, or ion components originating from an object of cleaning can be effectively dissolved in an aqueous phase, and the cleaning ability can be further enhanced.

More specifically, N-methyl-2-pyrrolidone (boiling point: 204° C., solubility in water: 100% by weight or more), N-ethyl-2-pyrrolidone (boiling point: 218° C., solubility in water: 100% by weight or more), dimethyl sulfoxide (boiling point: 189° C., solubility in water: 100% by weight or more), dimethylacetamide (boiling point: 166° C., solubility in water: 100% by weight or more), N,N-dimethylformamide (boiling point: 153° C., solubility in water: 100% by weight or more), N,N-diethylformamide (boiling point: 177° C., solubility in water: 100% by weight or more), and the like are preferred.

(2) Solubility

Furthermore, the solubility in water (measurement temperature: 20° C.) of the third organic solvent is adjusted to a value of 50% by weight or more.

The reason for this is that if such solubility has a value of below 50% by weight, it may be difficult for the third organic solvent to sufficiently dissolve ion components originating from an object of cleaning, in an aqueous phase.

Furthermore, it is because it may be difficult for the third organic solvent to act as an intermediary from the aqueous phase between water and the first organic solvent as well as the second organic solvent that have been converted to an emulsion state, and to bring enhancement of the dispersibility of the emulsion and enhancement of the cleaning ability.

Therefore, it is more preferable that the lower limit of the solubility in water (measurement temperature: 20° C.) of the third organic solvent to a value of 60% by weight or more, and even more preferably to a value of 70% by weight or more.

Meanwhile, the upper limit of the solubility in water (measurement temperature: 20° C.) of the third organic solvent is not particularly limited, and it is preferable that the upper limit is defined to be infinity (∞).

(3) Boiling Point

It is also preferable that the boiling point of the third organic solvent is adjusted to a value within the range of 150° C. to 220° C.

Meanwhile, the reason for defining the boiling point of the third organic solvent is similar to the reason for defining the boiling point of the first organic solvent.

Therefore, it is more preferable that the lower limit of the boiling point for the third organic solvent is adjusted to a value of 155° C. or higher, and even more preferably to a value of 160° C. or higher.

Furthermore, it is more preferable that the upper limit of the boiling point for the third organic solvent is adjusted to a value of 215° C. or lower, and even more preferably to a value of 210° C. or lower.

(4) Amount of Incorporation

The amount of incorporation of the third organic solvent is adjusted to a value within the range of 3 to 100 parts by weight with respect to 100 parts by weight of the first organic solvent.

The reason for this is that if such an amount of incorporation has a value of below 3 parts by weight, the absolute amount of the third organic solvent with respect to the first organic solvent may be insufficient, and it may be difficult for the third organic solvent to sufficiently dissolve ionic compounds such as organic acids and salts originating from flux residues, or ion components originating from an object of cleaning, in an aqueous phase.

Furthermore, it is because it may be difficult for the third organic solvent to act as an intermediary from the aqueous phase between water and the first organic solvent as well as the second organic solvent that have been converted to an emulsion state, and to bring enhancement of the dispersibility of the emulsion and enhancement of the cleaning ability.

Furthermore, it is because the surface tension of the aqueous phase may become excessively high, and thereby, the cleaning ability at the interstices between objects of cleaning may deteriorate, or it may be difficult to obtain satisfactory liquid drainability and dryability.

On the other hand, it is because if such an amount of incorporation has a value of above 100 parts by weight, phase separation may not easily occur, it may be difficult to obtain a white turbid state, and the cleaning ability is likely to deteriorate excessively.

Therefore, it is more preferable that the lower limit of the amount of incorporation of the third organic solvent is adjusted to a value of 5 parts by weight or more, and even more preferably to a value of 7 parts by weight or more, with respect to 100 parts by weight of the first organic solvent.

Furthermore, it is more preferable that the upper limit of the amount of incorporation of the third organic solvent is adjusted to a value of 90 parts by weight or less, and even more preferably to a value of 80 parts by weight or less, with respect to 100 parts by weight of the first organic solvent.

4. Fourth Organic Solvent

The fourth organic solvent of the invention is a hydrophilic amine compound having a solubility value in water (measurement temperature: 20° C.) of 50% by weight or greater.

Such a fourth organic solvent is incorporated in order to obtain a higher degree of cleaning ability, while deliberately deteriorating the resistance to metal corrosion.

That is, when the fourth organic solvent is incorporated, the electrical conductivity and pH of the aqueous phase increase, and therefore, potential difference corrosion and pH corrosion in an object of cleaning may easily occur.

Meanwhile, the fourth organic solvent acts as an intermediary from the aqueous phase between water and the first organic solvent that has been converted to an emulsion state and the like, contributes to enhancement of the dispersibility of the emulsion, and can effectively dissolve ionic compounds such as organic acids and salts originating from flux residues, or ion components originating from an object of cleaning, in an aqueous phase.

Therefore, the fourth organic solvent makes it possible to obtain particularly excellent cleaning ability under the assumption that the organic solvent is incorporated to the extent that that metal corrosion can be suppressed to a level at which there is no problem in practical use.

(1) Type

The fourth organic solvent is a hydrophilic amine compound.

More specifically, examples thereof include N-ethylpiperazine (boiling point: 157° C., solubility in water: 100% by weight or more), N,N-diethylisopropanolamine (boiling point: 159° C., solubility in water: 100% by weight or more), N-methylethanolamine (boiling point: 160° C., solubility in water: 100% by weight or more), monoisopropanolamine (boiling point: 160° C., solubility in water: 100% by weight or more), N,N-diethylethanolamine (boiling point: 162° C., solubility in water: 100% by weight or more), N-ethylethanolamine (boiling point: 169° C., solubility in water: 100% by weight or more), N-t-butylethanolamine (boiling point: 175° C., solubility in water: 100% by weight or more), 1-amino-4-methylpiperazine (boiling point: 178° C., solubility in water: 100% by weight or more), N-aminoethylpiperazine (boiling point: 182° C., solubility in water: 100% by weight or more), benzylamine (boiling point: 185° C., solubility in water: 100% by weight or more), and N-allylpiperazine (boiling point: 185° C., solubility in water: 100% by weight or more).

Furthermore, it is preferable that the number of carbon atoms in the hydrophilic amine compound as the fourth organic solvent is adjusted to a value within the range of 3 to 7, the number of hydrogen atoms is adjusted to a value within the range of 8 to 16, the number of nitrogen atoms is adjusted to a value within the range of 1 to 3, and the number of oxygen atoms is adjusted to 1.

The reason for this is that when such a fourth organic solvent is used, even if a small amount thereof is added in the case of cleaning an object of cleaning for which a particularly high degree of cleaning ability is required, the cleaning ability can be further enhanced.

Therefore, among the fourth organic solvents described above, it is particularly preferable to use at least one compound selected from the group consisting of N,N-diethylisopropanolamine, N-ethylethanolamine, N-methylethanolamine, benzylamine, and monoisopropanolamine.

(2) Solubility

Furthermore, the solubility in water (measurement temperature: 20° C.) of the fourth organic solvent is adjusted to a value of 50% by weight or greater.

The reason for this is that when such solubility has a value of below 50% by weight, despite that the fourth organic solvent has been deliberately incorporated from the viewpoint of further enhancing the cleaning ability, the fourth organic solvent is taken in into the oil phase side, and it may be difficult to sufficiently dissolve ionic compounds such as organic acids and salts originating from flux residues, or ion components originating from an object of cleaning, in an aqueous phase.

Furthermore, it is because it may be difficult for the fourth organic solvent to act as an intermediary from the aqueous phase between water and the first organic solvent that has been converted to an emulsion state and the like, and to bring enhancement of the dispersibility of the emulsion and further enhancement of the cleaning ability.

Therefore, it is more preferable that the lower limit of the solubility in water (measurement temperature: 20° C.) of the fourth organic solvent is adjusted to a value of 60% by weight or greater, and even more preferably to a value of 70% by weight or greater.

Meanwhile, the upper limit of the solubility in water (measurement temperature: 20° C.) of the fourth organic solvent is not particularly limited, and it is preferable that the upper limit is defined to be infinity (∞).

(3) Boiling Point

Furthermore, it is preferable that the boiling point of the fourth organic solvent is adjusted to a value within the range of 140° C. to 200° C.

Meanwhile, the reason for defining the boiling point of the fourth organic solvent is similar to the reason for defining the boiling point of the first organic solvent.

Therefore, it is more preferable that the lower limit of the boiling point for the fourth organic solvent is adjusted to a value of 145° C. or higher, and even more preferably to a value of 150° C. or higher.

Furthermore, it is more preferable that the upper limit of the boiling point for the fourth organic solvent is adjusted to a value of 195° C. or lower, and even more preferably to a value of 185° C. or lower.

(4) Amount of Incorporation

The amount of incorporation of the fourth organic solvent is adjusted to a value of below 0.1 parts by weight with respect to 100 parts by weight of the first organic solvent.

The reason for this is that if such an amount of incorporation has a value of 0.1 parts by weight or more, the electrical conductivity and pH of the aqueous phase increase, and metal corrosion is likely to occur in the object of cleaning.

Particularly, it is because in a case in which a lead frame obtained by die-bonding a semiconductor device that has an aluminum pad formed thereon is cleaned as an object of cleaning, since the potential difference corrosion and the pH corrosion simultaneously occur, usually, the aluminum pad having a thickness of about 1 μm is dissolved, and it may be difficult to stably obtain conduction in the final manufactured product.

Therefore, it is more preferable that the upper limit of the amount of incorporation of the fourth organic solvent is adjusted to a value of 0.07 parts by weight or less, and even more preferably to a value of 0.05 parts by weight or less, with respect to 100 parts by weight of the first organic solvent, and it is most preferable that the upper limit is 0 parts by weight, that is, the fourth organic solvent is not incorporated.

However, for example, in the case of cleaning an object of cleaning that requires a particularly high degree of cleaning ability, such as component parts for vehicles and high-frequency components, for which high reliability is required, and semiconductor package substrates for high-density packaging, it is also preferable that a very small amount of the fourth organic solvent is incorporated to the extent that metal corrosion can be suppressed to a level at which there is no problem for practical use.

In this case, it is preferable that the lower limit of the amount of incorporation of the fourth organic solvent is adjusted to a value of 0.01 parts by weight or more, more preferably to a value of 0.03 parts by weight or more, and even more preferably to a value of 0.05 parts by weight or more, with respect to 100 parts by weight of the first organic solvent.

Next, the relation between the amount of incorporation of the fourth organic solvent and the electrical conductivity and pH of the aqueous phase will be explained using FIG. 1.

That is, in FIG. 1, the horizontal axis represents the amount of incorporation (parts by weight) of the fourth organic solvent with respect to 100 parts by weight of propylene glycol monobutyl ether in the cleaner composition according to Comparative Example 6, the left vertical axis represents a characteristic curve A representing the electrical conductivity (μS/cm) at 25° C. of the aqueous phase, and the right vertical axis represents a characteristic curve B representing the pH (–) at 25° C. of the aqueous phase.

The details of the methods for measuring electrical conductivity and pH of the aqueous phase will be described in the Examples.

Comparative Example 6 corresponds to a conventional turbid cleaner composition containing a hydrophilic amine compound as an essential compound.

From such characteristic curves A and B in FIG. 1, it is understood that the electrical conductivity and pH of the aqueous phase monotonously increase as the amount of incorporation of the fourth organic solvent increases.

More specifically, as disclosed by the characteristic curve A, it is understood that when the amount of incorporation of the fourth organic solvent has a value of 0.1 parts by weight or more, the electrical conductivity of the aqueous phase has a value of 120 μS/cm or higher.

Furthermore, as disclosed by the characteristic curve B, it is understood that when the amount of incorporation of the fourth organic solvent has a value of 0.1 parts by weight or more, the pH of the aqueous phase increases to a value of 9.6 or higher.

Therefore, as will be explained in the following description using FIG. 2, when the amount of incorporation of the fourth organic solvent increases, potential difference corrosion attributable to high electrical conductivity and pH corrosion attributable to high pH are likely to occur.

Next, the relation between the amount of incorporation of the fourth organic solvent and the resistance to metal corrosion and the cleaning ability will be explained using FIG. 2.

Figure 2:
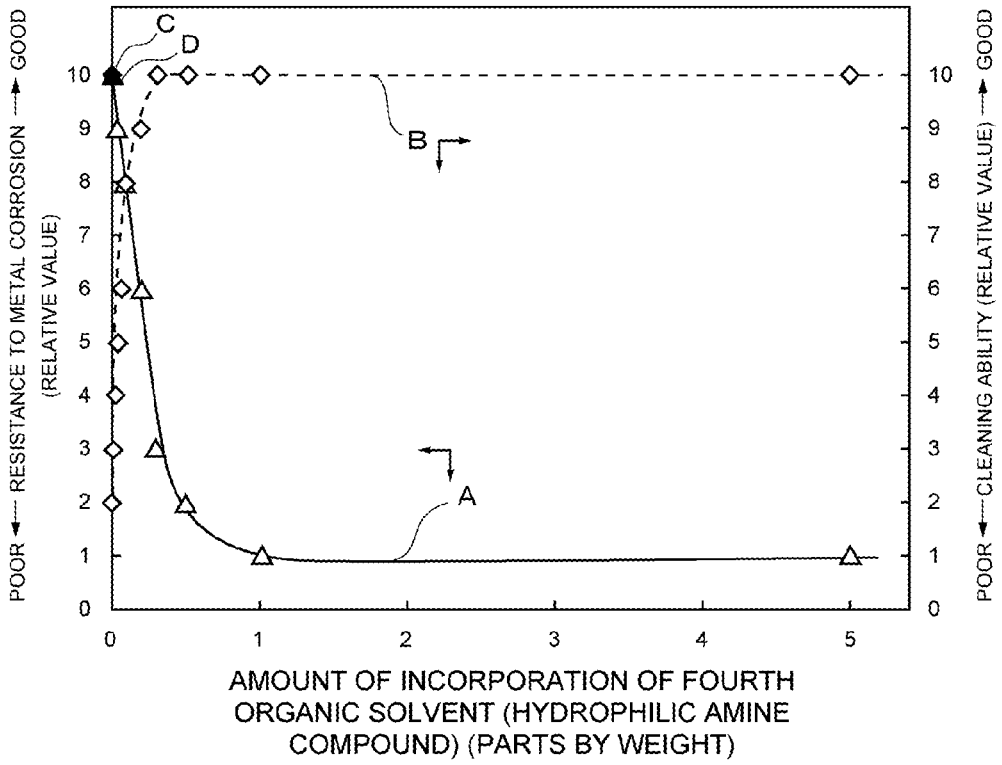
FIG. 2 is a diagram provided to explain the relations between the amount of incorporation of the fourth organic solvent and the resistance to metal corrosion and the cleaning ability.

That is, in FIG. 2, the horizontal axis represents the amount of incorporation (parts by weight) of the fourth organic solvent with respect to 100 parts by weight of propylene glycol monobutyl ether in the cleaner composition according to Comparative Example 6, the left vertical axis represents a characteristic curve A representing the resistance to metal corrosion (relative value), and the right vertical axis represents a characteristic curve B representing the cleaning ability (relative value).

Here, the evaluation results (relative values) for corrosion resistance are indicated with evaluation points from 0 to 10, and the evaluation criteria are as follows.

Evaluation point 10: No change in the external appearance is observed after immersion for 60 minutes.

Evaluation point 9: No change in the external appearance is observed after immersion for 45 minutes; however, a change in the external appearance is observed after immersion for 60 minutes.

Evaluation point 8: No change in the external appearance is observed after immersion for 30 minutes; however, a change in the external appearance is observed after immersion for 45 minutes.

Evaluation point 7: No change in the external appearance is observed after immersion for 25 minutes; however, a change in the external appearance is observed after immersion for 30 minutes.

Evaluation point 6: No change in the external appearance is observed after immersion for 20 minutes; however, a change in the external appearance is observed after immersion for 25 minutes.

Evaluation point 5: No change in the external appearance is observed after immersion for 15 minutes; however, a change in the external appearance is observed after immersion for 20 minutes.

Evaluation point 4: No change in the external appearance is observed after immersion for 10 minutes; however, a change in the external appearance is observed after immersion for 15 minutes.

Evaluation point 3: No change in the external appearance is observed after immersion for 5 minutes; however, a change in the external appearance is observed after immersion for 10 minutes.

Evaluation point 2: No change in the external appearance is observed after immersion for 3 minutes; however, a change in the external appearance is observed after immersion for 5 minutes.

Evaluation point 1: No change in the external appearance is observed after immersion for 1 minute; however, a change in the external appearance is observed after immersion for 3 minutes.

Evaluation point 0: A change in the external appearance is observed after immersion for 1 minute.

Furthermore, the evaluation results (relative values) for cleaning ability are indicated with evaluation points from 0 to 10, and the evaluation criteria are as follows.

Evaluation point 10: The flux cleaning time is 0 minutes or longer and shorter than 10 minutes.

Evaluation point 9: The flux cleaning time is 10 minutes or longer and shorter than 12 minutes.

Evaluation point 8: The flux cleaning time is 12 minutes or longer and shorter than 15 minutes.

Evaluation point 7: The flux cleaning time is 15 minutes or longer and shorter than 17 minutes.

Evaluation point 6: The flux cleaning time is 17 minutes or longer and shorter than 20 minutes.

Evaluation point 5: The flux cleaning time is 20 minutes or longer and shorter than 25 minutes.

Evaluation point 4: The flux cleaning time is 25 minutes or longer and shorter than 30 minutes.

Evaluation point 3: The flux cleaning time is 30 minutes or longer and shorter than 40 minutes.

Evaluation point 2: The flux cleaning time is 40 minutes or longer and shorter than 50 minutes.

Evaluation point 1: The flux cleaning time is 50 minutes or longer and shorter than 60 minutes.

Evaluation point 0: The flux cleaning time is 60 minutes or longer.

The details of the methods for evaluating the resistance to metal corrosion and the cleaning ability will be described in the Examples.

From such characteristic curves A and B in FIG. 2, it is understood that as the amount of incorporation of the fourth organic solvent increases, the evaluation point for the resistance to metal corrosion decreases, and as the amount of incorporation of the fourth organic solvent increases, the evaluation point for the cleaning ability increases.

More specifically, as disclosed by the characteristic curve A, it is understood that when the amount of incorporation of the fourth organic solvent is 0 parts by weight, the evaluation value for the resistance to metal corrosion is 10, whereas when the amount of incorporation of the fourth organic solvent is 1 part by weight or more, the evaluation value for the resistance to metal corrosion sharply decreases to 1.

Meanwhile, as disclosed by the characteristic curve B, it is understood that when the amount of incorporation of the fourth organic solvent is 0 parts by weight, the evaluation value for the cleaning ability is 0, whereas when the amount of incorporation of the fourth organic solvent is 0.4 parts by weight or more, the evaluation value for the cleaning ability sharply increases to 10.

Therefore, it is understood that in conventional turbid cleaner compositions that contain a hydrophilic amine compound as an essential component, it is very difficult to achieve a balance between the resistance to metal corrosion and the cleaning ability.

Meanwhile, FIG. 2 shows a plot C representing the resistance to metal corrosion and a plot D representing the cleaning ability with regard to the cleaner composition of Example 1, in addition to the characteristic curves A and B.

From such plots C and D, it is understood that when the cleaner composition of the present invention is used, the cleaner composition can exhibit excellent cleaning ability even in a case in which the composition does not include a hydrophilic amine compound at all, and therefore, excellent resistance to metal corrosion and cleaning ability are obtained at the same time.

5. Other Compounds

Furthermore, in the cleaner composition of the present invention, compounds other than the first to fourth organic solvents described above may also be incorporated to the extent that the effects of the present invention are not impaired.

These compounds are no particularly limited; however, examples thereof include a hydrophobic glycol ether compound, a hydrophobic amine compound, and a surfactant.

Examples of the hydrophobic glycol ether compound include propylene glycol monobutyl ether and dipropylene glycol dimethyl ether.

Examples of the hydrophobic amine compound include dibutylamine, 2-ethylhexylamine, triallylamine, and dimethylbenzylamine.

Examples of the surfactant include a polyoxyethylene alkyl ether, a polyoxyethylene alkyl phenyl ether, a polyoxyethylene polypropylene alkyl ether, a polyoxyethylene sorbitan fatty acid ester, a polyoxyethylene glycol fatty acid ester, a polyoxyethylene alkylamine, a polyoxyethylene benzyl alcohol, and a polyglycerin fatty acid ester.

Particularly, when the fourth organic solvent is incorporated, from the viewpoint of suppressing the occurrence metal corrosion more effectively, it is also preferable to incorporate a pH buffer material, a pH adjusting agent, an antirust agent, an oxidation preventing agent, and the like.

In addition, it is preferable that the amount of incorporation of the other compounds is adjusted to a value within the range of 0.1 to 10 parts by weight, and more preferably to a value within the range of 1 to 7 parts by weight, with respect to 100 parts by weight of the first organic solvent.

6. Water

The cleaner composition of the present invention is mixed with water in an amount within the range of 50 to 3,900 parts by weight with respect to 100 parts by weight of the total amount of the organic solvents described above.

The reason for this is that if such amount of incorporation of water has a value of below 50 parts by weight, the cleaning ability may be deteriorated, the cleaner composition may become uniform, and it may be difficult to obtain a white turbid state.

On the other hand, if such amount of incorporation of water has a value of above 3,900 parts by weight, the organic solvents may be excessively diluted, and the cleaning ability may be deteriorated noticeably.

Therefore, it is more preferable that the lower limit of the amount of incorporation of water is adjusted to a value of 75 parts by weight or more, and even more preferably to a value of 100 parts by weight or more.

Furthermore, it is more preferable that the upper limit of the amount of incorporation of water is adjusted to a value of 1,900 parts by weight or less, and even more preferably to a value of 900 parts by weight or less.

7. Liquid characteristics (1) Water Concentration in Oil Phase

When the cleaner composition of the present invention is subjected to phase separation into an oil phase and an aqueous phase, the water concentration in the oil phase (measurement temperature: 25° C.) is adjusted to a value of 5% by weight or less.

The reason for this is that in a case in which the amount of incorporation of the hydrophilic amine compound is limited from the viewpoint of suppressing metal corrosion, the cleaning ability tends to deteriorate noticeably; however, when the predetermined mixing composition is assumed, and the water concentration in the oil phase is adjusted to a predetermined range or less, excellent cleaning ability can be maintained effectively.

That is, it is because when such water concentration has a value of above 5% by weight, it is difficult for the first organic solvent or second organic solvent that constitutes the oil phase, to sufficiently exhibit the excellent cleaning ability that is originally possessed by the organic solvents in a water-free state.

More specifically, it is because when the first organic solvent or second organic solvent that constitutes the oil phase includes water at a predetermined proportion or more, the dissolution power for non-polar compounds such as rosins originating from flux residues is reduced, and the cleaning ability deteriorates noticeably.

Therefore, it is more preferable that the water concentration in the oil phase (measurement temperature: 25° C.) is adjusted to a value of 3% by weight or less, and even more preferably to a value of 1.5% by weight or less.

Meanwhile, the "water concentration in the oil phase" according to the present invention means the saturated water concentration in the oil phase.

Next, the relation between the water concentration in the oil phase and the cleaning ability will be explained using FIG. 3.

Figure 3:
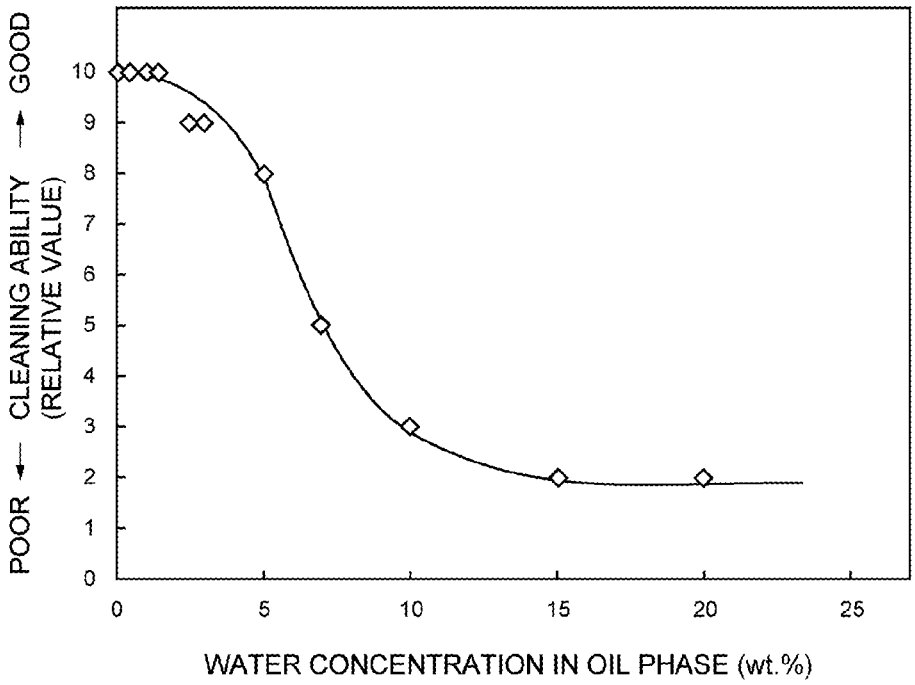
FIG. 3 is a diagram provided to explain the relation between the water concentration in an oil phase and the cleaning ability.

That is, in FIG. 3, the horizontal axis represents the water concentration (wt %) at 25° C. in the oil phase in the cleaner composition according to Example 3, and the vertical axis represents a characteristic curve representing the cleaning ability (relative value).

Meanwhile, the criteria for the evaluation results for the cleaning ability are similar to the case of FIG. 2.

From such a characteristic curve in FIG. 3, it is understood that the cleaning ability deteriorates as the water concentration in the oil phase increases.

More specifically, it is understood that when the water concentration in the oil phase is within the range of 0% to 5% by weight or less, the evaluation value of the cleaning ability decreases relatively mildly from 10 to 8. It is also understood that, on the other hand, if the water concentration in the oil phase is above 5% by weight, the evaluation value for the cleaning ability begins to decrease sharply, and when the water concentration in the oil phase reaches 7% by weight, the evaluation value decreases to 5; when the water concentration in the oil phase reaches 10% by weight, the evaluation value decreases to 3; while when the water concentration in the oil phase reaches 15% by weight, the evaluation value decreases to 2.

Therefore, it is understood that in order to obtain excellent cleaning ability, the water concentration in the oil phase should be adjusted to a value of 5% by weight or less.

(2) Electrical Conductivity in Aqueous Phase

Furthermore, it is preferable that the electrical conductivity of the aqueous phase (measurement temperature: 25° C.) is adjusted to a value within the range of 0.1 to 300 μS/cm.

The reason for this is that if such electrical conductivity has a value of below 0.1 μS/cm, metal ions are brought into a state of being easily dissoluble, and the influence of metal is likely to be manifested.

On the other hand, it is because if such electrical conductivity has a value of above 300 μS/cm, potential difference corrosion may easily occur in the object of cleaning.

Therefore, it is more preferable that the lower limit of the electrical conductivity of the aqueous phase is adjusted to a value of 0.3 μS/cm or higher, and even more preferably to a value of 0.5 μS/cm or higher.

Furthermore, it is more preferable that the upper limit of the electrical conductivity of the aqueous phase is adjusted to a value of 250 μS/cm or lower, and even more preferably to a value of 200 μS/cm or lower.

(3) pH in Aqueous Phase

Furthermore, it is preferable that the pH of the aqueous phase (measurement temperature: 25° C.) is adjusted to a value within the range of 4.5 to 9.5.

The reason for this is that if such pH has a value of below 4.5, pH corrosion is likely to occur in the object of cleaning, and the cleaning effect on flux may be deteriorated noticeably.

On the other hand, it is because if such pH has a value of above 9.5, pH corrosion is likely to occur in the object of cleaning.

Therefore, it is more preferable that the lower limit of the pH of the aqueous phase is adjusted to a value of 5 or higher, and even more preferably to a value of 5.5 or higher.

Also, it is more preferable that the upper limit of the pH of the aqueous phase is adjusted to a value of 9 or lower, and even more preferably to a value of 8.5.

(4) Flash Point and Combustion Point

It is preferable that the cleaner composition of the present invention does not have a flash point, or even in a case in which the cleaner composition has a flash point, the temperature has a value of 40° C. or higher, and the cleaner composition has a combustion point value of 60° C. or higher.

The reason for this is that if such a flash point has a value of 40° C. or higher and such a combustion point has a value of 60° C. or higher, the cleaner composition is not classified as a hazardous material under the Fire Services Act.

However, if the flash point and the combustion point of the cleaner composition become excessively high, the types or the amounts of incorporation of the first to fourth organic solvents and the like that can be used may be excessively limited.

Therefore, even in a case in which the cleaner composition has a flash point, it is more preferable that the temperature is adjusted to a value within the range of 45° C. to 150° C., and even more preferably to a value within the range of 50° C. to 100° C.

Furthermore, it is more preferable that the combustion point of the cleaner composition is adjusted to a value within the range of 70° C. to 200° C., and even more preferably to a value within the range of 80° C. to 150° C.

The flash point of the cleaner composition can be measured according to JIS K 2265-1 and 4 (method for determining the flash point), as will be described in Example 1.

Second Embodiment

A second embodiment is a cleaning method of cleaning an object of cleaning by bringing the cleaner composition of the first embodiment into a white turbid state.

1. Cleaner Composition Preparing Step

The cleaner composition preparing step is a step of preparing the cleaner composition explained in the first embodiment.

Therefore, if the cleaner composition has been already produced, the cleaner composition may be used as received; however, for example, in a case in which only the organic solvent portion (cleaner composition stock solution) has been produced, a cleaner composition is prepared by mixing 50 to 3,900 parts by weight of water with 100 parts by weight of the cleaner composition stock solution.

2. Cleaning Step (1) Mode of Cleaning

On the occasion of carrying out the cleaning method using the cleaner composition, the cleaning method is not particularly limited, and for example, various means such as an immersion method, a swinging method, an ultrasonic vibration method, a shower cleaning method, and a submerged jetting method can be employed.

Furthermore, it is also preferable that flux is cleaned in a state in which the cleaner composition is impregnated into or attached to a brush, a cleaning roll, or the like.

On the occasion of carrying out the cleaning method using the cleaner composition, it is particularly preferable to use the cleaning apparatus that will be described below.

(2) Cleaning Conditions

Furthermore, on the occasion of carrying out the cleaning method using the cleaner composition, it is preferable that cleaning is performed under the conditions of, for example, 30° C. to 80° C. for from 10 seconds to 60 minutes.

The reason for this is that if a predetermined cleaning effect could be obtained under such conditions, thermal deterioration or oxidative deterioration of the cleaner composition itself can be effectively prevented.

Meanwhile, in order to manifest excellent cleaning ability by bringing the cleaner composition into a white turbid state, as one of the cleaning conditions, it is preferable that the cleaner composition is brought into a stirred state.

More specifically, it is preferable that the cleaner composition is brought into a stirred state using a propeller stirring device, a magnet stirrer, or the like, by setting the speed of rotation to the range of 30 to 1,000 rpm.

3. Rinsing Step

Since the cleaner composition of the present invention exhibits excellent dryability, basically, a rinsing step may be omitted.

However, in regard to cleaning of electronic components, substrates, and the like, since there are occasions in which galvanic corrosion or the like occurs in electronic components, substrates, and the like as a result of the cleaner composition remaining thereon, it is also preferable to further provide a rinsing step.

Particularly, in a case in which the cleaner composition includes a hydrophilic amine compound, it is preferable to use an alcohol-based solvent as the rinsing liquid.

The reason for this is that an alcohol-based solvent can be quickly dried as compared to water, and the influence of metal can be suppressed when a hydrophilic amine compound has been mixed in.

More specifically, it is preferable to use alcohols such as methyl alcohol, ethyl alcohol, propyl alcohol, isopropyl alcohol, butyl alcohol, isobutyl alcohol, t-butyl alcohol, s-butyl alcohol, amino alcohol, and 1-methoxy-2-propanol as the alcohol-based solvent, the alcohols being used singly or in combination of two or more kinds thereof.

Furthermore, it is preferable to use an alcohol-based solvent obtained by adding a predetermined amount of water to these alcohols, and specifically, it is preferable to use an alcohol-based solvent in which water has been added in an amount of 40% to 70% by weight with respect to the total amount.

Regarding the rinsing conditions, it is more preferable that a rinsing treatment is carried out in two stages by setting the rinsing conditions to 5° C. to 40° C. for a time within the range of from 1 second to 30 minutes. The reason for this is that the residues of surfactants or amine compounds can be further reduced.

However, in a case in which any flux that has attached to a solder processing apparatus or the like should be removed, since the problem of deterioration of the electrical characteristics of electronic components, substrates, and the like caused by any surfactants and the like remaining thereon is negligible, such a rinsing step may be omitted or may be simplified.

4. Cleaning Apparatus

Figure 4A:
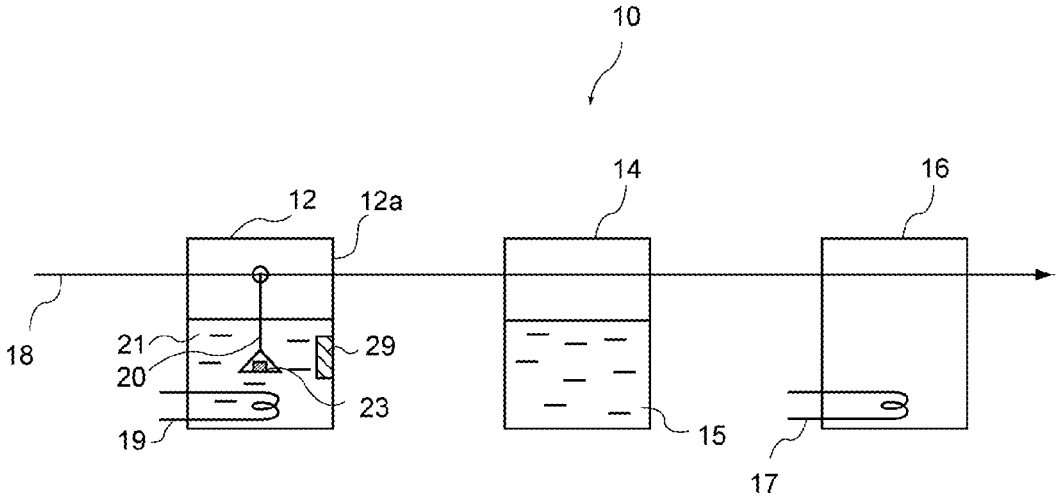
FIGS. 4(*a*) and 4(*b*) are diagrams provided to explain an example of a cleaning apparatus.
Figure 4B:
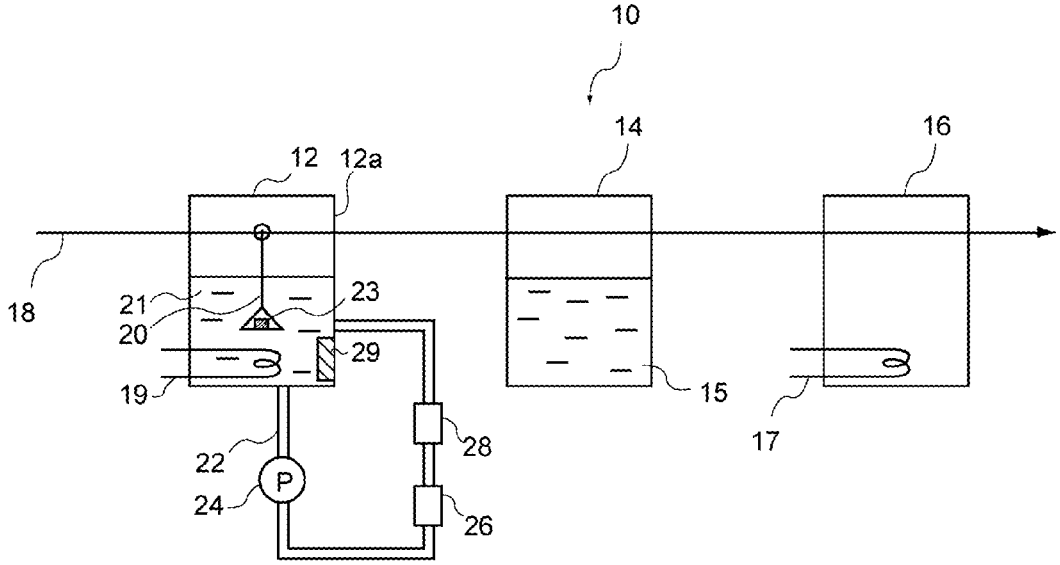

Regarding the flux cleaning apparatus 10 that is used on the occasion of carrying out the cleaning method using the cleaner composition, as illustrated in FIG. 4(*a*), it is preferable that the cleaning apparatus includes, for example, a cleaning tank 12 equipped with an ultrasonic vibrator 29 for performing ultrasonic cleaning; a rinsing tank 14; and a drying tank 16.

More specifically, the cleaning tank 12 is composed of a housing 12*a*; an accommodating unit 20 for an object of cleaning 23; an ultrasonic vibrator 29; a cleaning liquid stirring apparatus (not shown in the diagram); and a heater 19 equipped with an automatic temperature regulator, and it is preferable that the object of cleaning 23 is efficiently cleaned as the ultrasonic vibrator 29 applies ultrasonic vibration to the cleaner composition 21 that is being stirred and circulated.

Furthermore, as illustrated in FIG. 4(*b*), it is also preferable that the cleaning tank 12 is composed of a housing 12*a*; an accommodating unit 20 for an object of cleaning 23; an ultrasonic vibrator 29; a cleaning liquid stirring apparatus (not shown in the diagram); a heater 19 equipped with an automatic temperature regulator; and a circulation channel 22 for circulating a cleaner composition 21.

That is, the cleaner composition 21 that has been partially contaminated can be circulated by means of a pump 24, and the cleaner composition 21 can be regenerated in the middle of the circulation, by a filter 28 provided in the circulation channel 22 or by a salt-forming compound accommodating unit 26.

Next, it is preferable that in the rinsing tank 14, flux and the like are further eliminated from the object of cleaning 23, while the cleaner composition 21 is also removed, and in the drying tank 16, the rinsing liquid 15 or the like is completely removed through evaporation.

That is, by using such a cleaning apparatus 10, solder-processed electronic components, substrates and the like can be cleaned using the cleaner composition of the present invention, and the flux adhering to those can be efficiently removed, while metal corrosion is effectively suppressed.

5. Object of Cleaning

On the occasion of carrying out the cleaning method using the cleaner composition, the type of the object of cleaning to which the cleaner composition is applied is not particularly limited; however, the cleaner composition can be suitably applied to solder-processed electronic components and substrates, as well as to component parts that are under the influence of flux even though they are not solder-processed.

Therefore, specific examples include printed circuit boards, ceramic wiring boards, semiconductor devices (including semiconductor components such as BGA, CSP, PGA, and LGA), semiconductor device-mounted boards, bump-attached TAB tapes, bump-free TAB tapes, semiconductor device-mounted TAB tapes, lead frames, condensers, and resistors.

Furthermore, it is preferable that the object of cleaning contains, in an exposed surface, at least one metal selected from the group consisting of magnesium, aluminum, phosphorus, titanium, chromium, iron, nickel, copper, zinc, germanium, palladium, silver, indium, tin, antimony, platinum, gold, lead, and bismuth, or an alloy containing that metal.

The reason for this is that when the cleaning method of the present invention is used, even if the cleaning method is directed to such an object of cleaning, the occurrence of metal corrosion can be effectively suppressed.

Examples of such an object of cleaning include a lead frame obtained by die-bonding semiconductor devices that use aluminum pads, and a packaging substrate integrated with an aluminum heat sink for heat dissipation.

Meanwhile, the case in which the metal or alloy mentioned above is not exactly exposed to the surface because an oxide coating or the like has been formed thereon, is also intended to be included in the category of "containing (the metal or alloy) in an exposed surface".

Furthermore, there are no particular limitations on the type of flux that is used on such an object of cleaning; however, for example, the flux is preferably a conventional solder flux, a low-VOC flux, a lead-free solder flux, a halogen-free solder flux, a high-melting point solder flux, or a non-cleaning solder flux.

That is, it is because in many cases, these solder fluxes usually contain rosins as a main component, and have added thereto at least one compound selected from an organic acid salt, a glycidyl ether compound, an oxyacid, a carboxylic acid (including a dicarboxylic acid), an anilide, and a thermosetting resin (for example, an epoxy resin or a thermosetting acrylic resin).

Therefore, when the cleaning method of the present invention is used, excellent cleaning ability can be shown for conventional solder fluxes as well as these solder fluxes.

The type of the conventional solder, high-melting point solder, lead-free solder, non-cleaning solder, and the like, to which fluxes are added, is also not particularly limited; however, representative examples include Sn—Ag-based solders, Sn—Ag—Cu-based solders, Sn—Cu-based solders, Sn—Sb-based solders, Sn—Zn-based solders, Sn—Bi-based solders, and Pb—Sn-based solders.

EXAMPLES

Hereinafter, the present invention will be described in detail by way of Examples. However, it is needless to say that the present invention is not limited by the following descriptions.

Example 1

1. Production of Cleaner Composition Stock Solution 100 parts by weight of cymene (boiling point: 177° C., solubility in water: 1% by weight or less) as a first organic solvent, 15 parts by weight of 1-hexanol (boiling point: 157° C., solubility in water: 1% by weight or less) as a second organic solvent, and 35 parts by weight of N-methyl-2-pyrrolidone (boiling point: 204° C., solubility in water: 100% by weight or more) as a third organic solvent were accommodated in a vessel, and the mixture was sufficiently stirred to become uniform, using a mixer as a stirring apparatus. The resultant was used as a cleaner composition stock solution of Example 1.

The mixing composition of the cleaner composition stock solution of Example 1 is presented in Table 1.

2. Production of Cleaner Composition

A cleaner composition was obtained by accommodating 100 parts by weight of the cleaner composition stock solution thus obtained and 233.3 parts by weight of water in a vessel, and sufficiently stirring the mixture using a mixer as a stirring apparatus.

3. Evaluation (1) Evaluation of water concentration in oil phase 200 g of the cleaner composition thus obtained was accommodated in a 300-ml beaker, and then the cleaner composition was left to stand for one hour in an environment at a temperature of 25° C.

Next, the water concentration in the oil phase formed as a result of phase separation was measured using a Karl-Fischer moisture titrator (manufactured by Kyoto Electronics Manufacturing Co., Ltd., MKS-500). The results thus obtained are presented in Table 1.

(2) Evaluation of Electrical Conductivity in Aqueous Phase 200 g of the cleaner composition thus obtained was accommodated in a 300-ml beaker, and then the cleaner composition was left to stand for one hour in an environment at a temperature of 25° C.

Next, between an oil phase and an aqueous phase formed as a result of phase separation, the aqueous phase was extracted, and the electrical conductivity of the aqueous phase thus extracted was measured using a conductivity meter, CEH-12 (manufactured by Kos21 Co., Ltd.). The results thus obtained are presented in Table 1.

(3) Evaluation of pH in Aqueous Phase 200 g of the cleaner composition thus obtained was accommodated in a 300-ml beaker, and then the cleaner composition was left to stand for one hour in an environment at a temperature of 25° C.

Next, among an oil phase and an aqueous phase formed as a result of phase separation, the aqueous phase was extracted.

Next, the pH of the aqueous phase thus extracted was measured using a pH meter (manufactured by Horiba, Ltd., M-8) under the conditions of a measurement temperature of 25° C. The results thus obtained are presented in Table 1.

(4) Evaluation of Resistance to Metal Corrosion 200 g of the cleaner composition thus obtained was accommodated in a 300-ml beaker, and then the temperature was maintained at 50° C.

Figure 5A:
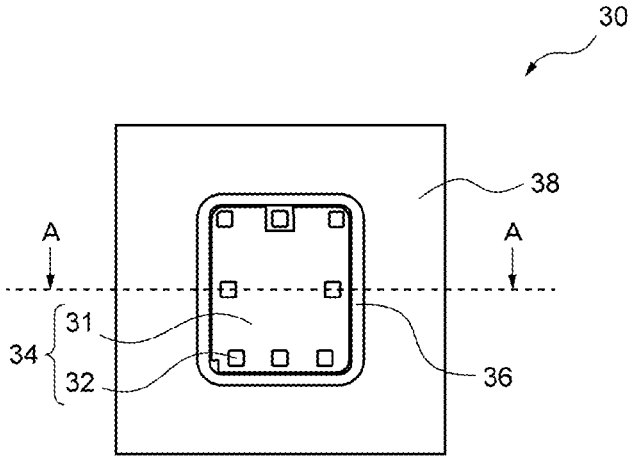
FIGS. 5(*a*) and 5(*b*) are diagrams provided to explain a test piece for evaluating the resistance to metal corrosion.
Figure 5B:
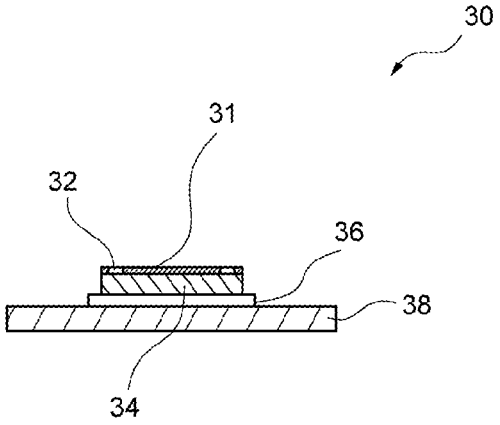

Next, a copper plate 38 on which a semiconductor device 34 including a bonding pad part formed from aluminum as a main raw material ((aluminum pad) 32 was fixed by solder 36 as illustrated in FIGS. 5(*a*) and 5(*b*), was used as a test piece 30 and was accommodated in a beaker containing 200 g of the cleaner composition. In that state, while the cleaner composition was brought into a white turbid state by rotating a magnetic stirrer in the beaker, a corrosion test was performed for a predetermined time period.

Next, the rotation of the magnetic stirrer was stopped, the test piece 30 was taken out from the cleaner composition, and the test piece 30 was dried for a predetermined time period using a circulating oven that was maintained at 100° C.

Subsequently, the dried test piece 30 was taken out from the circulating oven, the surface was observed by visual inspection, and thus an evaluation on the resistance to metal corrosion of the cleaner composition was performed according to the following criteria. The results thus obtained are presented in Table 1.

FIG. 5(*a*) is a plan view of the test piece 30, and FIG. 5(*b*) is a cross-sectional view obtainable when a cross-section produced by cutting the test piece 30 of FIG. 5(*a*) along the dotted line was viewed along the direction of arrow A.

⊙ (Very good): No change in the external appearance is observed in the copper plate and the aluminum pad after immersion for 60 minutes.

○ (Good): No change in the external appearance is observed in the copper plate and the aluminum after immersion for 30 minutes; however, a change in the external appearance is observed after immersion for 60 minutes.

Δ (Fair): No change in the external appearance is observed in the copper plate and the aluminum after immersion for 15 minutes; however, a change in the external appearance is observed after immersion for 30 minutes.

X (Bad): A change in the external appearance is observed in the copper pad and the aluminum pad after immersion for 15 minutes.

(5) Evaluation of Cleaning Ability

On a JIS2 type comb-shaped substrate, ECO SOLDER M705-GRN360-K2-V (manufactured by Senju Metal Industry Co., Ltd.) as a commercially available lead-free solder paste was applied by print-coating through a metal mask.

Next, the comb-shaped substrate print-coated with a solder paste was placed on a hot plate with a cover, which was maintained at a temperature of 240° C., and the commercially available solder paste was caused to reflow. This was used as a test piece.

Meanwhile, 200 g of the cleaner composition thus obtained was accommodated in a 300-ml beaker, and then the cleaner composition was maintained at a temperature of 50° C.

Next, a plurality of test pieces were accommodated in the beaker containing the cleaner composition, and in that state, a cleaning test for the solder paste was performed by varying the cleaning time, while the cleaner composition was brought into a white turbid state by rotating a magnetic stirrer.

That is, after each predetermined cleaning time, the rotation of the magnetic stirrer was stopped, several test pieces were taken out from the cleaner, and the test pieces were dried for 10 minutes using a circulating oven that was maintained at 100° C.

Lastly, the dried test pieces were taken out from the circulating oven, and the surfaces were observed using a stereoscopic microscope (magnification ratio: 40). Thus, the time during which the solder paste could be completely cleaned (cleaning time) was measured, and also, the cleaning ability was evaluated according to the following criteria. The results thus obtained are presented in Table 1.

⊙ (Very good): The cleaning time is shorter than 10 minutes.

○ (Good): The cleaning time is 10 minutes or longer and shorter than 15 minutes.

Δ (Fair): The cleaning time is 15 minutes or longer and shorter than 30 minutes.

X (Bad): The cleaning time is 30 minutes or longer.

(6) Evaluation of Dryability 200 g of the cleaner composition thus obtained was accommodated in a 300-ml beaker, and then the temperature was maintained at 50° C.

Next, a glass epoxy substrate was accommodated in the beaker containing 200 g of the cleaner composition, and in that state, a cleaning test that lasted for 30 minutes was performed while the cleaner composition was brought into a white turbid state by rotating a magnetic stirrer in the beaker.

Next, the rotation of the magnetic stirrer was stopped, the glass epoxy substrate was taken out from the cleaner, and the glass epoxy substrate was dried for a predetermined time using a circulating oven that was maintained at 100° C.

Subsequently, the dried glass epoxy substrate was taken out from the circulating oven, the surface was observed by visual inspection, and an evaluation on the dryability of the cleaner composition was performed according to the following criteria. The results thus obtained are presented in Table 1.

⊙ (Very good): The cleaner composition can be dried within 5 minutes.

○(Good): The cleaner composition can be dried within 10 minutes.

Δ (Fair): After drying for 10 minutes, a slight amount of liquid residue is observed.

X (Bad): After drying for 10 minutes, a large amount of liquid residue is observed.

(7) Flash Point

The flash point of the cleaner composition thus obtained was measured according to JIS K2265-1:2007 (Determination of flash point (tag closed-cup method)) and JIS K2265-4:2007 (Determination of flash point (Cleveland open-cup method)). The results thus obtained are presented in Table 1.

Examples 2 to 12 and Comparative Examples 1 to 9

In Examples 2 to 12 and Comparative Examples 1 to 9, cleaner compositions were produced in the same manner as in Example 1, except that the composition of the cleaner composition was changed as indicated in Table 1, and the cleaner compositions were evaluated. The results thus obtained are presented in Table 1.

TABLE 1

| | Cleaner composition | | | | | | | | |
|---|---|---|---|---|---|---|---|---|---|
| | Cleaner composition stock solution | | | | | | | | |
| | First organic solvent | | Second organic solvent | | Third organic solvent | | Other organic solvent | | Water |
| | Compound name | Amount of incorporation (parts by weight) | Compound name | Amount of incorporation (parts by weight) | Compound name | Amount of incorporation (parts by weight) | Compound name | Amount of incorporation (parts by weight) | Amount of incorporation (parts by weight) |
| Example 1 | Cymene | 100.0 (20.0) | 1-Hexanol | 15.0 (3.0) | N-methyl-2-pyrrolidone | 35.0 (7.0) | — | — | 233.3 (70.0) |
| Example 2 | Cumene | 100.0 (20.0) | 2-Heptanol | 35.0 (7.0) | N-ethyl-2-pyrrolidone | 15.0 (3.0) | — | — | 233.3 (70.0) |
| Example 3 | Decahydronaphthalene | 100.0 (22.0) | 1-Heptanol | 45.5 (10.0) | N-methyl-2-pyrrolidone | 36.4 (8.0) | — | — | 150.0 (60.0) |

TABLE 1-continued

| | | | | | | | | | |
|---|---|---|---|---|---|---|---|---|---|
| Example 4 | Decahydro-naphthalene | 100.0 (4.0) | 1-Heptanol | 12.5 (0.5) | N-methyl-2-pyrrolidone | 12.5 (0.5) | — | — | 1900.0 (95.0) |
| Example 5 | Decahydro-naphthalene Cymene | 66.7 (14.0) 33.3 (7.0) | Benzyl alcohol | 33.3 (7.0) | Dimethyl sulfoxide | 33.3 (7.0) | — | — | 185.7 (65.0) |
| Example 6 | Decahydro-naphthalene | 100.0 (8.0) | Diisobutyl-carbinol | 75.0 (6.0) | Dimethyl acetamide | 75.0 (6.0) | — | — | 400.0 (80.0) |
| Example 7 | Indene | 100.0 (20.0) | Cyclohexanol | 75.0 (15.0) | N-methyl-2-pyrrolidone | 25.0 (5.0) | — | — | 150.0 (60.0) |
| Example 8 | Phenetole | 100.0 (15.0) | 1-Octanol | 46.7 (7.0) | N,N-dimethyl-formamide | 53.3 (3.0) | — | — | 233.3 (70.0) |
| Example 9 | p-Menthane | 100.0 (10.0) | 1-Hexanol | 60.0 (6.0) | N,N-diethyl-formamide | 40.0 (4.0) | — | — | 400.0 (80.0) |
| Example 10 | Decahydro-naphthalene | 100.0 (6.0) | 1-Heptanol | 25.0 (1.5) | N-methyl-2-pyrrolidone | 33.3 (2.0) | Propylene glycol monobutyl ether | 8.3 (0.5) | 900.0 (90.0) |
| Example 11 | Decahydro-naphthalene | 100.0 (20.0) | 1-Heptanol | 32.5 (6.5) | N-methyl-2-pyrrolidone | 32.5 (6.5) | Dibutylamine | 2.5 (0.5) | 198.5 (66.5) |
| Example 12 | Decahydro-naphthalene | 100.0 (23.0) | 1-Heptanol | 4.3 (1.0) | N-methyl-2-pyrrolidone | 4.3 (1.0) | N-ethylethanolamine | 0.04 (0.01) | 300.0 (75.0) |
| Comparative Example 1 | — | — | 1-Heptanol | 100.0 (15.0) | N-methyl-2-pyrrolidone | 100.0 (15.0) | — | — | 233.3 (70.0) |
| Comparative Example 2 | Decahydro-naphthalene | 100.0 (25.0) | — | — | N-methyl-2-pyrrolidone | 60.0 (15.0) | — | — | 150.0 (60.0) |
| Comparative Example 3 | Cymene | 100.0 (25.0) | 2-Heptanol | 60.0 (15.0) | — | — | — | — | 150.0 (60.0) |
| Comparative Example 4 | — | — | — | — | — | — | Propylene glycol monobutyl ether ethylene glycol monoisobutyl ether | 100.0 (24.0) 66.7 (16.0) | 150.0 (60.0) |
| Comparative Example 5 | Cumene | 100.0 (22.0) | Benzyl alcohol | 40.9 (9.0) | N-ethyl-2-pyrrolidone | 36.4 (8.0) | N-ethylethanolamine | 9.1 (2.0) | 150.0 (60.0) |
| Comparative Example 6 | — | — | — | — | — | — | N-ethylethanolamine propylene glycol monobutyl ether ethylene glycol monoisobutyl ether | 11.1 (2.1) 100.0 (18.9) 47.6 (9.0) | 233.3 (70.0) |
| Comparative Example 7 | Decahydro-naphthalene | 100.0 (6.0) | Benzyl alcohol | 33.3 (2.0) | N-ethyl-2-pyrrolidone | 33.3 (2.0) | Propylene glycol monobutyl ether | 500.0 (30.0) | 150.0 (60.0) |
| Comparative Example 8 | Decahydro-naphthalene | 100.0 (3.0) | 1-Heptanol | 533.3 (16.0) | N-methyl-2-pyrrolidone | 33.3 (1.0) | — | — | 400.0 (80.0) |
| Comparative Example 9 | Cumene | 100.0 (4.0) | 1-Heptanol | 25.0 (1.0) | N-ethyl-2-pyrrolidone | 625.0 (25.0) | — | — | 233.3 (70.0) |

| | Evaluation | | | | | | |
|---|---|---|---|---|---|---|---|
| | Water concentration in oil phase (wt %) | pH (−) of aqueous phase | Electrical conductivity of aqueous (μs/cm) | Resistance to metal corrosion | Cleaning ability | Dry-ability | Flash point (° C.) |
| Example 1 | 0.4 | 6.2 | 2.3 | ⊙ | ⊙ | ⊙ | 70 |
| Example 2 | 0.8 | 6.4 | 2.9 | ⊙ | ⊙ | ⊙ | 54 |
| Example 3 | 0.7 | 6.5 | 2.0 | ⊙ | ⊙ | ⊙ | 76 |
| Example 4 | 0.2 | 7.2 | 1.5 | ⊙ | ⊙ | ⊙ | 78 |
| Example 5 | 0.5 | 6.4 | 2.3 | ⊙ | ⊙ | ○ | 74 |
| Example 6 | 1.6 | 6.8 | 3.2 | ⊙ | ⊙ | ⊙ | 66 |
| Example 7 | 0.6 | 6.8 | 2.3 | ⊙ | ⊙ | ○ | 72 |
| Example 8 | 1.2 | 6.5 | 3.1 | ⊙ | ⊙ | ⊙ | 62 |
| Example 9 | 1.0 | 6.7 | 2.8 | ⊙ | ⊙ | ⊙ | 52 |
| Example 10 | 0.6 | 8.1 | 2.2 | ⊙ | ○ | ⊙ | 78 |
| Example 11 | 0.5 | 7.8 | 8.0 | ⊙ | ⊙ | ⊙ | 74 |
| Example 12 | 0.1 | 10.2 | 280.0 | ○ | ⊙ | ⊙ | 64 |
| Comparative Example 1 | 7.0 | 8.2 | 2.2 | ⊙ | X | ○ | 99 |

TABLE 1-continued

| | | | | | | | |
|---|---|---|---|---|---|---|---|
| Comparative Example 2 | 0.1 | 5.8 | 2.4 | ⊙ | Δ | ○ | 72 |
| Comparative Example 3 | 0.9 | 6.4 | 1.9 | ⊙ | X | ⊙ | 74 |
| Comparative Example 4 | 18.0 | 8.5 | 3.2 | ⊙ | X | ⊙ | 92 |
| Comparative Example 5 | 6.0 | 11.5 | 580.0 | X | ⊙ | ⊙ | 54 |
| Comparative Example 6 | 20.0 | 11.6 | 630.0 | X | ⊙ | ⊙ | 95 |
| Comparative Example 7 | 8.9 | 7.8 | 2.4 | ⊙ | X | ⊙ | 96 |
| Comparative Example 8 | 5.6 | 6.3 | 19.1 | ⊙ | Δ | ⊙ | 79 |
| Comparative Example 9 | 0.1 | 8.9 | 1.7 | ⊙ | Δ | Δ | 65 |

* The amounts of incorporation (parts by weight) of the various components in the cleaner composition stock solutions represent values calculated by designating the amount of incorporation of the first organic solvent as 100 parts by weight.
* The values within parentheses in the columns for the amounts of incorporation of the various components in the cleaner composition stock solutions represent the amounts of incorporation (wt %) of the various components with respect to the total amount of the cleaner composition.
* The amount of incorporation (parts by weight) of water in the cleaner composition represents the amount of incorporation of water with respect to 100 parts by weight of the cleaner composition stock solution.
* The values within parentheses in the column for the amount of incorporation of water in the cleaner composition represent the amounts of incorporation (wt %) of water with respect to the total amount of the cleaner composition.
* Among the organic solvents described in the column for "Other organic solvents", "N-ethylethanolamine" is included in the fourth organic solvent.

INDUSTRIAL APPLICABILITY

When the cleaner composition of the present invention is used, predetermined hydrophobic organic solvents as first and second organic solvents, a predetermined hydrophilic organic solvent as a third organic solvent, and water are mixed at predetermined proportions; a hydrophilic amine compound as a fourth organic solvent is not included, or even if included, the amount is limited to be less than a predetermined range so that the cleaner composition is made substantially amineless; and the water concentration in the oil phase obtainable after phase separation is adjusted to a predetermined range or less. Thus, excellent environmental safety and excellent cleaning ability can be manifested, and metal corrosion in an object of cleaning can be effectively suppressed.

Therefore, when the cleaner composition of the present invention and a cleaning method that uses the cleaner composition are used, particularly even in the case of cleaning electronic components, in which metal corrosion easily occurs and that corrosion is fatal to the components, such as a lead frame obtained by soldering a semiconductor device that uses an aluminum pad, flux residues can be removed accurately and stably, while environmental problems are taken care of.

EXPLANATIONS OF LETTERS OR NUMERALS

10: CLEANING APPARATUS
12: CLEANING TANK
14: RINSING TANK
15: RINSING LIQUID
16: DRYING TANK
21: CLEANING LIQUID
22: CIRCULATING CHANNEL
26: SALT-FORMING COMPOUND ACCOMMODATING UNIT
28: FILTER
29: ULTRASONIC VIBRATOR
30: TEST PIECE FOR EVALUATING RESISTANCE TO METAL CORROSION
31: POLYIMIDE PROTECTIVE FILM
32: ALUMINUM PAD
34: SEMICONDUCTOR COMPONENT
36: SOLDER
38: COPPER PLATE

The invention claimed is:

1. A cleaner composition for cleaning an object of cleaning in a white turbid state, the cleaner composition comprising first to fourth organic solvents and water, wherein the first organic solvent is at least one compound selected from the group consisting of a hydrophobic aromatic compound, a hydrophobic terpene-based compound, and a hydrophobic naphthene-based compound, all of the compounds having a solubility value in water, at a measurement temperature of 20° C., of 10% by weight or less, the second organic solvent is a hydrophobic monoalcohol compound having a solubility value in water, at a measurement temperature of 20° C., of 10% by weight or less, and the second organic solvent is at least one selected from the group consisting of 1-hexanol, methyl amyl alcohol, 2-ethyl butyl alcohol, methyl isobutyl carbinol, cyclohexanol, 1-heptanol, 2-heptanol, 3-heptanol, 4-heptanol, 2-methylcyclohexanol, benzyl alcohol, 1-octanol, 2-octanol, 2-ethylhexanol, 2-nonanol, diisobutylcarbinol, and 3,5,5-trimethylhexanol, the third organic solvent is a hydrophilic nitrogen-containing compound and a hydrophilic sulfur-containing compound, or any one of the compounds, both the compounds having a solubility value in water, at a measurement temperature of 20° C., of 50% by weight or greater, and the hydrophilic nitrogen-containing compound is at least one selected from the group consisting of N-methyl-2-pyrrolidone, N-ethyl-2-pyrrolidone, dimethylacetamide, N,N-dimethylformamide, and N,N-diethylformamide, the fourth organic solvent is a hydrophilic amine compound having a solubility value in water, at a measurement temperature of 20° C., of 50% by weight or greater, the amount of incorporation of the second organic solvent is adjusted to a value within the range of 3 to 100 parts by weight with respect to 100 parts by weight of the first organic solvent, the amount of incorporation of the third organic solvent is adjusted to a value within the range of 3 to 100 parts by weight with respect to 100 parts by weight of the first organic solvent, the amount of the fourth organic solvent is adjusted to a value of below 0.1 parts by weight with respect to 100 parts by weight of the first organic solvent, the amount of incorporation of water is adjusted to a value within the range of 50 to 3,900 parts by weight with respect to 100 parts by weight of the total amount of the organic solvents, and when the cleaner composition is subjected to phase separation into an oil phase and an aqueous phase, the water concentration in the oil phase, at a measurement temperature of 25° C., is adjusted to a value of 5% by weight or less.

2. The cleaner composition according to claim 1, wherein the electrical conductivity of the aqueous phase, at a measurement temperature of 25° C., is adjusted to a value within the range of 0.1 to 300 μS/cm.

3. The cleaner composition according to claim 1, wherein the pH of the aqueous phase, at a measurement temperature of 25° C., is adjusted to a value within the range of 4.5 to 9.5.

4. The cleaner composition according to claim 1, wherein the boiling point of the first organic solvent is adjusted to a value within the range of 140° C. to 210° C., the boiling point of the second organic solvent is adjusted to a value within the range of 130° C. to 220° C., and the boiling point of the third organic solvent is adjusted to a value within the range of 150° C. to 220° C.

5. The cleaner composition according to claim 1, wherein the number of carbon atoms in the hydrophobic aromatic compound, hydrophobic terpene-based compound, and hydrophobic naphthene-based compound as the first organic solvent is adjusted to a value within the range of 8 to 10, the number of hydrogen atoms is adjusted to a value within the range of 8 to 20, and the number of oxygen atoms is adjusted to a value within the range of 0 to 1.

6. The cleaner composition according to claim 1, wherein the number of carbon atoms in the hydrophobic monoalcohol compound as the second organic solvent is adjusted to a value within the range of 6 to 10, the number of hydrogen atoms is adjusted to a value within the range of 8 to 20, and the number of oxygen atoms is adjusted to 1.

7. The cleaner composition according to claim 1, wherein the number of carbon atoms in the hydrophilic nitrogen-containing compound as the third organic solvent is adjusted to a value within the range of 3 to 6, the number of hydrogen atoms is adjusted to a value within the range of 7 to 12, the number of nitrogen atoms is adjusted to 1, and the number of oxygen atoms is adjusted to 1; and the number of carbon atoms in the hydrophilic sulfur-containing compound is adjusted to a value within the range of 2 to 3, the number of hydrogen atoms is adjusted to a value of 6 to 10, the number of sulfur atoms is adjusted to 1, and the number of oxygen atoms is adjusted to 1.

8. The cleaner composition according to claim 1, wherein the number of carbon atoms in the hydrophilic amine compound as the fourth organic solvent is adjusted to a value within the range of 3 to 7, the number of hydrogen atoms is adjusted to a value within the range of 8 to 16, the number of nitrogen atoms is adjusted to a value within the range of 1 to 3, and the number of oxygen atoms is adjusted to 1.

9. The cleaner composition according to claim 1, wherein the object of cleaning contains, in an exposed surface, at least one metal selected from the group consisting of magnesium, aluminum, phosphorus, titanium, chromium, iron, nickel, copper, zinc, germanium, palladium, silver, indium, tin, antimony, platinum, gold, lead, and bismuth, or an alloy containing that metal.

10. A cleaning method, comprising a step for preparing the cleaner composition according to claim 1, a step for placing the cleaner composition and an object of cleaning into a cleaning tank, a step for stirring the cleaner composition to bring the composition into a white turbid state, and a step for cleaning the object with the cleaner composition in the white turbid state.

* * * * *